US010308032B2

(12) United States Patent
Koizumi et al.

(10) Patent No.: US 10,308,032 B2
(45) Date of Patent: Jun. 4, 2019

(54) CARTRIDGE FOR LIQUID JETTING APPARATUS

(71) Applicant: SEIKO EPSON CORPORATION, Tokyo (JP)

(72) Inventors: Yoshihiro Koizumi, Shiojiri (JP); Hitoshi Matsumoto, Matsumoto (JP); Masahisa Nawano, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/885,101

(22) Filed: Jan. 31, 2018

(65) Prior Publication Data

US 2018/0215161 A1 Aug. 2, 2018

(30) Foreign Application Priority Data

Feb. 1, 2017 (JP) ..... 2017-016534

(51) Int. Cl.
*B41J 2/175* (2006.01)
*B41J 2/195* (2006.01)

(52) U.S. Cl.
CPC ..... *B41J 2/17513* (2013.01); *B41J 2/175* (2013.01); *B41J 2/17503* (2013.01); *B41J 2/17523* (2013.01); *B41J 2/17553* (2013.01); *B41J 2/17556* (2013.01); *B41J 2/195* (2013.01); *B41J 2002/17516* (2013.01)

(58) Field of Classification Search
CPC ..... B41J 2/17513; B41J 2/175; B41J 2/195; B41J 2/17503; B41J 2/17556; B41J 2/17553; B41J 2/17523; B41J 2002/17516
See application file for complete search history.

(56) References Cited

U.S. PATENT DOCUMENTS 6,293,666 B1 * 9/2001 Mou ..... B41J 2/17513 222/105
9,616,671 B2 4/2017 Koizumi et al.
(Continued)

FOREIGN PATENT DOCUMENTS

JP 2005-254570 A 9/2005
JP 2006-027617 A 2/2006
(Continued)

OTHER PUBLICATIONS

Extended European Search Report dated Jun. 20, 2018 in related European Appl. 18154098.0 (10 pgs.).

*Primary Examiner* — Bradley W Thies
(74) *Attorney, Agent, or Firm* — Foley & Lardner LLP

(57) ABSTRACT

Provided is a cartridge that improves the effect of agitating ink. The cartridge is mounted to a liquid jetting apparatus that includes an air supply apparatus and a liquid jetting unit, and includes a liquid container that contains liquid, a case that includes the liquid container, and an air bag that is positioned between an internal wall of the case and the liquid container, and contacts with the liquid container in a state of being expanded upon being supplied with air. The air bag includes a first bag and a second bag that is positioned above the first bag. The air bag and the liquid container are aligned in a first direction intersecting an up-down direction. when viewed in the first direction, the first bag is arranged to overlap a lower part of the center in the up-down direction of the liquid container.

7 Claims, 22 Drawing Sheets

(56) References Cited

U.S. PATENT DOCUMENTS

| | | | | |
|---|---|---|---|---|
| 2005/0243149 | A1 | 11/2005 | Matsumoto | |
| 2014/0263431 | A1* | 9/2014 | Nilsson | B41J 2/175 222/61 |
| 2016/0288511 | A1* | 10/2016 | Koizumi | B41J 2/1752 |
| 2016/0288514 | A1 | 10/2016 | Koizumi et al. | |

FOREIGN PATENT DOCUMENTS

| | | | |
|---|---|---|---|
| JP | 2008-230008 | A | 10/2008 |
| JP | 2016-187894 | A | 11/2016 |
| JP | 2016-187898 | A | 11/2016 |
| JP | 2016-187899 | A | 11/2016 |

* cited by examiner

CARTRIDGE FOR LIQUID JETTING APPARATUS

CROSS-REFERENCE TO RELATED APPLICATIONS

The present application claims the priority based on Japanese Patent Applications No. 2017-016534 filed on Feb. 1, 2017, the disclosures of which are hereby incorporated by reference in their entirety.

BACKGROUND

1. Technical Field

The present invention relates to a cartridge and the like.

2. Related Art

Heretofore, inkjet printers have been known as examples of a liquid jetting apparatus. In inkjet printers, printing can be performed on a printing medium such as printing paper by discharging ink, which is an example of liquid, from a jetting head onto the printing medium. Regarding such inkjet printers, a mode is known in which ink contained in a cartridge is supplied to the jetting head. Heretofore, a configuration has been known in which such a cartridge has an ink container that contains ink, a case that houses the ink container, and an air bag arranged between an internal wall of the case and the ink container (for example, see JP-A-2016-187894).

JP-A-2016-187894 is an example of related art.

In the cartridge described in above JP-A-2016-187894, the air bag includes a first air bag and a second air bag. The first air bag and the second air bag are arranged in the front-back direction of the cartridge. The ink container extends from a position adjacent to the first air bag to a position adjacent to the second air bag. This configuration allows ink to flow in the front-back direction in the ink container by alternately expanding/contracting the first air bag and the second air bag, and thus the ink in the ink container can be agitated effectively.

Incidentally, the purpose of agitating ink is to reduce a difference in concentration in the up-down direction caused by gravity. In order to effectively reduce the difference in concentration in the up-down direction, a lower portion of the ink container is preferably pressed. However, in the above-described cartridge, the air bag that is inflated is unlikely to reach a lower portion of the ink container. This is partly because the above-described air bag of the cartridge is made of a so-called gusset-type bag having upper and lower gusset portions, and has a height substantially equivalent to that of the ink container in the up-down direction. In such an air bag, the peak of a bulge of the air bag is likely to be positioned at a central portion of the ink container in the up-down direction. Therefore, in the above-described cartridge, the inflated air bag is unlikely to reach a lower portion of the ink container. Thus, with the above-described cartridge, there is an issue in that it is hard to improve the agitation effect. The invention has been made in order to solve such an issue, and is aimed to provide a cartridge that makes it easier to improve the effect of agitating ink.

SUMMARY

The invention can be realized as the following modes or application examples.

APPLICATION EXAMPLE 1

A cartridge that is mounted to a liquid jetting apparatus that includes an air supply apparatus that supplies air and a liquid jetting unit that jets liquid, the cartridge includes a liquid container that contains the liquid, at least a portion of the liquid container being flexible, a case that includes the liquid container, and an air bag that is positioned between an internal wall of the case and the liquid container, at least a portion of which is flexible, and that contacts with the liquid container in a state of being expanded upon being supplied with the air, the air bag includes a first bag that is expanded upon being supplied with the air and a second bag that is positioned above the first bag when the cartridge is in use, and is expanded upon being supplied with the air, the air bag and the liquid container are aligned in a first direction intersecting an up-down direction when the cartridge is in use, and when the cartridge is in use, and the cartridge is viewed in the first direction, the first bag is arranged to overlap a lower part of the center in the up-down direction of the liquid container.

In this cartridge, the first bag of the air bag that includes the first bag and the second bag is arranged at a position overlapping a portion below the center in the up-down direction in the liquid container. Therefore, it is possible to bring the first bag into contact with the portion below the center in the up-down direction in the liquid container when the air bag is expanded upon receiving a supply of air. Accordingly, the expanded air bag easily reaches a lower portion of the liquid container. Thus, in this cartridge, the effect of agitating the liquid in the liquid container is easily improved.

APPLICATION EXAMPLE 2

In the above-described cartridge, the air bag includes a pillow-type bag, the pillow-type bag is divided into the first bag and the second bag.

In this cartridge, the air bag has a configuration in which a pillow-type bag is divided into the first bag and the second bag, and thus the air bag can be formed with a simple configuration.

APPLICATION EXAMPLE 3

In the above-described cartridge, the pillow-type bag includes a configuration in which edges of two overlapped film materials are joined through welding, and in a joint portion formed through welding, notch portions are formed in a portion adjacent to the first bag in a direction intersecting the up-down direction and the first direction, and a portion adjacent to the second bag in the direction intersecting the up-down direction and the first direction.

In this cartridge, in the joint portion of the pillow-type bag, the notch portions are respectively formed in a portion adjacent to the first bag and a portion adjacent to the second bag in the direction intersecting the up-down direction and the first direction. Here, when the pillow-type bag is inflated, the joint portion formed through welding is likely to be resistant to inflation and deformation of the bag, and thus the shape of the bag when inflated is unlikely to be stable at a fixed shape. If this occurs, a mode in which the liquid container is pressed by the air bag is likely to change every time the liquid container is pressed, and thus a stable agitation effect is unlikely to be acquired. In this regard, with the above-described cartridge, deformation of the joint portion is likely to be concentrated on the notch portions, and thus the shape of the pillow-type bag when inflated is likely to be stabilized at a fixed shape. As a result, a stable agitation effect is easily acquired, and thus it is possible to easily improve the agitation effect further.

APPLICATION EXAMPLE 4

In the above-described cartridge, an introduction port for introducing the air into the air bag is included so as to be shared by the first bag and the second bag, an introduction path that branches into the first bag and the second bag from the introduction port is formed in the pillow-type bag, and the introduction path includes a configuration in which surface press molding has been performed on at least one film material out of the two film materials.

In this cartridge, the introduction path formed in the pillow-type bag has a configuration in which surface press molding has been performed on at least one film material out of the two film materials, and thus it is easy to avoid blockage of the introduction path due to the two film materials adhering to each other. Accordingly, the shape of the pillow-type bag when inflated is likely to be stabilized at a fixed shape. As a result, a stable agitation effect is easily acquired, and it is possible to easily further improve the agitation effect.

APPLICATION EXAMPLE 5

In the above-described cartridge, a second air bag that is expanded upon being supplied with the air is provided, the liquid container is divided into a first container and a second container, the first container and the second container are aligned in a second direction intersecting the up-down direction and the first direction, and are communicated with each other at a lower part of the center in the up-down direction of the liquid container, and the first air bag is arranged at a position opposing the first container, and the second air bag is arranged at a position opposing the second container.

In this cartridge, in the liquid container that is divided into the first container and the second container, the first container can be pressed by the first air bag, and the second container can be pressed by the second air bag.

APPLICATION EXAMPLE 6

In the above-described cartridge, the liquid container is a flexible bag, and is divided into the first container and the second container by a clamping member that clamps a portion of the bag from outside the bag.

In this cartridge, due to the clamping member clamping a portion of the bag, the bag can be divided into the first container and the second container.

APPLICATION EXAMPLE 7

In the above-described cartridge, the clamping member includes a clamping portion that clamps the bag and an expansion holding portion that configures to communicate with the first container and the second container each other, by holding a portion of the bag in a state of being expanded, and a rigidity member configures to heighten rigidity of the bag, the rigidity member is joined to a portion of the bag overlapping with the expansion holding portion.

In this cartridge, the rigidity of the portion of the bag that is expanded by the expansion holding portion is improved, and thus the expanded portion of the bag is likely to be held in a state of being expanded. Therefore, communication between the first container and the second container is easily maintained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
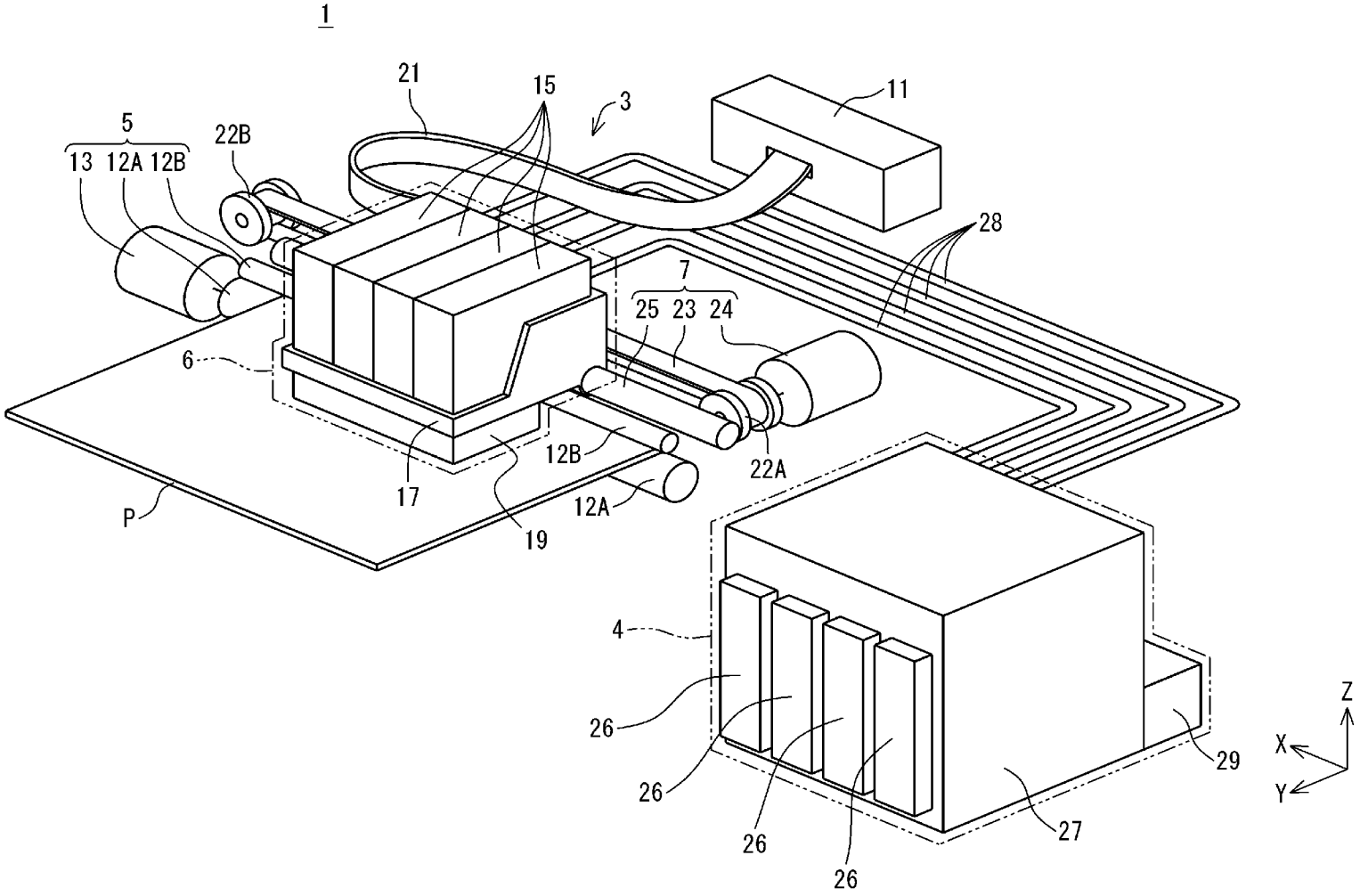
FIG. 1 is a perspective view schematically showing a main configuration of a liquid jetting system in an embodiment of the invention.

An embodiment of a printing apparatus will be described while taking a liquid jetting system as an example, with reference to the drawings. Note that, in the drawings, the scale of constituent parts and members may be different such that the respective constituent parts are shown with a recognizable size.

A liquid jetting system 1 in this embodiment has a printer 3 that is an example of a liquid jetting apparatus and an ink supply apparatus 4 that is an example of a printing material supply apparatus, as shown in FIG. 1. The printer 3 has a conveyance apparatus 5, a printing unit 6, a movement apparatus 7, and a control unit 11.

Here, in FIG. 1, X, Y, and Z axes that are coordinate axes orthogonal to each other are given. In the figures shown hereinafter, the X, Y, and Z axes are given as necessary. In this case, the X, Y, and Z axes in the drawings correspond to the X, Y, and Z axes FIG. 1. FIG. 1 illustrates a state where the liquid jetting system 1 is arranged on an XY plane defined by the X axis and the Y axis. In this embodiment, a state where the liquid jetting system 1 is arranged on the XY plane when the XY plane is made to match a horizontal flat face is an in-use state of the liquid jetting system 1. The orientation of the liquid jetting system 1 when the liquid jetting system 1 is arranged on the XY plane that is made to match a horizontal face is called a usage orientation of the liquid jetting system 1.

Note that the horizontal face may be a substantially horizontal face. The substantially horizontal face includes an inclination within the range of an inclination of a face recommended for use of the liquid jetting system 1, for example. Accordingly, the substantially horizontal face is not limited to a face of a highly accurately formed surface plate or the like. Examples of the substantially horizontal face include various surfaces of a desk, a mounting stool, a shelf, and a floor on which the liquid jetting system 1 is placed for use.

In the following description, when the X axis, the Y axis, and the Z axis are given in diagrams or description illustrating constituent parts and units of the liquid jetting system 1, the X axis, the Y axis, and the Z axis in a state where the constituent parts and units are incorporated (mounted) in the liquid jetting system 1 are meant. In addition, the orientations of the constituent parts and units in the usage orientation of the liquid jetting system 1 are referred to as usage orientations of those constituent parts and units. Hereinafter, the liquid jetting system 1, the constituent parts and units thereof, and the like are described as being in their usage orientations, unless specifically stated otherwise.

The Z axis is an axis orthogonal to the XY plane. In the in-use state of the liquid jetting system 1, the Z axis direction is the vertical upward direction. Also, in the in-use state of the liquid jetting system 1, in FIG. 1, a −Z axis direction is the vertical downward direction. Note that for each of the X, Y, and Z axes, the direction of an arrow indicates a + (positive) direction, and a direction opposite to the direction of the arrow indicates a − (negative) direction. In addition, the vertically upward direction or "vertically above" refer to the upward direction or "above" along the vertical line. Similarly, the vertical downward direction or "vertically below" refer to the downward direction or "below" along the vertical line. An upward direction or "above" without "vertically" is not limited to the upward direction or "above" along the vertical line, and includes an upward direction or "above" along a direction intersecting the vertical line, except for the horizontal direction. Also, a downward direction or "below" without "vertically" is not limited to the downward direction or "below" along the vertical line, and includes a downward direction or "below" along a direction intersecting the vertical line, except for the horizontal direction.

The conveyance apparatus 5 intermittently conveys a printing medium P such as recording paper in the Y axis direction. The printing unit 6 performs recording on the printing medium P conveyed by the conveyance apparatus 5, using ink that is an example of a liquid. The movement apparatus 7 reciprocally moves the printing unit 6 along the X axis. The ink supply apparatus 4 supplies ink to the printing unit 6. The control unit 11 controls driving of the above-described constituent elements.

The conveyance apparatus 5 has a driving roller 12A, a driven roller 12B, and a conveyance motor 13 as shown in FIG. 1. The driving roller 12A and the driven roller 12B are configured to be rotatable with their outer circumferential surfaces being in contact with each other. The conveyance motor 13 generates motive power for rotatively driving the driving roller 12A. The motive power from the conveyance motor 13 is transmitted to the driving roller 12A via a transmission mechanism. The printing medium P clamped between the driving roller 12A and the driven roller 12B is then intermittently conveyed in the Y axis direction.

The printing unit 6 has four relay units 15, a carriage 17, and a printing head 19. The relay units 15 relay ink supplied from the ink supply apparatus 4 to the printing head 19. The printing head 19 is an example of a liquid jetting unit, and discharges ink as ink droplets so as to perform recording on the printing medium P. The carriage 17 is equipped with the four relay units 15 and the printing head 19. Note that the printing head 19 is connected to the control unit 11 via a flexible cable 21. The discharge of ink droplets from the printing head 19 is controlled by the control unit 11.

The movement apparatus 7 has a timing belt 23, a carriage motor 24, and a guiding shaft 25 as shown in FIG. 1. The timing belt 23 is stretched between a pair of pulleys 22A and 22B. The pair of pulleys 22A and 22B are aligned along the X axis. Therefore, the timing belt 23 is stretched along the X axis. The carriage motor 24 generates motive power for rotatively driving the pulley 22A. The guiding shaft 25 extends along the X axis. The two ends of the guiding shaft 25 are supported by a box (not illustrated), and the guiding shaft 25 guides the carriage 17 along the X axis.

The carriage 17 is fixed to a portion of the timing belt 23. Motive power is transmitted from the carriage motor 24 to the carriage 17 via the pulley 22A and the timing belt 23. Also, the carriage 17 is configured to be able to reciprocally move along the X axis using the transmitted motive power.

As shown in FIG. 1, cartridges 26 are detachably mounted to the ink supply apparatus 4. Also, the ink supply apparatus 4 has a holder 27 that is an example of a mounting portion, and a pump unit 29. Note that in this embodiment, a plurality of (in this embodiment, four) cartridges 26 can be mounted to the ink supply apparatus 4. The four cartridges 26 are detachably supported by the holder 27. A pack unit (which will be described later) that is an example of a liquid containing body is housed in each of the cartridges 26. The pack unit has an ink container that is an example of a liquid container. Ink is sealed in the ink container made of a flexible film material.

An ink supply tube 28 is connected to the pack unit in the cartridge 26. The ink supply tube 28 that is an example of a channel member is connected to each of the relay units 15 from the ink supply apparatus 4. The four relay units 15 are respectively connected to the pack units of the cartridges 26 via the ink supply tubes 28. In the process of supplying ink from the cartridges 26 to the respective relay units 15, pressure is applied by the pump unit 29 to ink in the cartridges 26. Due to this, the ink in the cartridges 26 is sent to the relay units 15 via the ink supply tubes 28, respectively. Accordingly, the supply of ink from the ink supply apparatus 4 to the printing head 19 can be assisted using the pump unit 29.

In this manner, ink in the cartridges 26 is supplied from the ink supply apparatus 4 to the printing head 19 via the relay units 15. The ink supplied to the printing head 19 is then discharged as ink droplets from nozzles (not illustrated) directed toward the printing medium P. Note that in the above example, a description was given in which the printer 3 and the ink supply apparatus 4 have separate configurations, but the ink supply apparatus 4 can be included in the configuration of the printer 3. Also, the ink supply apparatus 4 and the pump unit 29 can have separate configurations. Note that driving of the pump unit 29 is controlled by the control unit 11.

In the liquid jetting system 1 that has the above-described configuration, driving of the conveyance motor 13 is controlled by the control unit 11, and the conveyance apparatus 5 intermittently conveys the printing medium P in the Y axis direction such that the printing medium P faces the printing head 19. At this time, the control unit 11 controls driving of the printing head 19 so as to discharge ink droplets at a predetermined position while controlling driving of the carriage motor 24 so as to reciprocally move the carriage 17 along the X axis. Due to such an operation, dots are formed on the printing medium P, and recording that is based on recording information such as image data is performed on this printing medium P. Note that the configuration of the liquid jetting system 1 is not limited to a configuration in which the carriage 17 that can move the printing head 19 along the X axis is included. As the liquid jetting system 1, a mode of a line head type can also be adopted in which the printing head 19 is arranged over the width along the X axis of the printing medium P.

Figure 2:
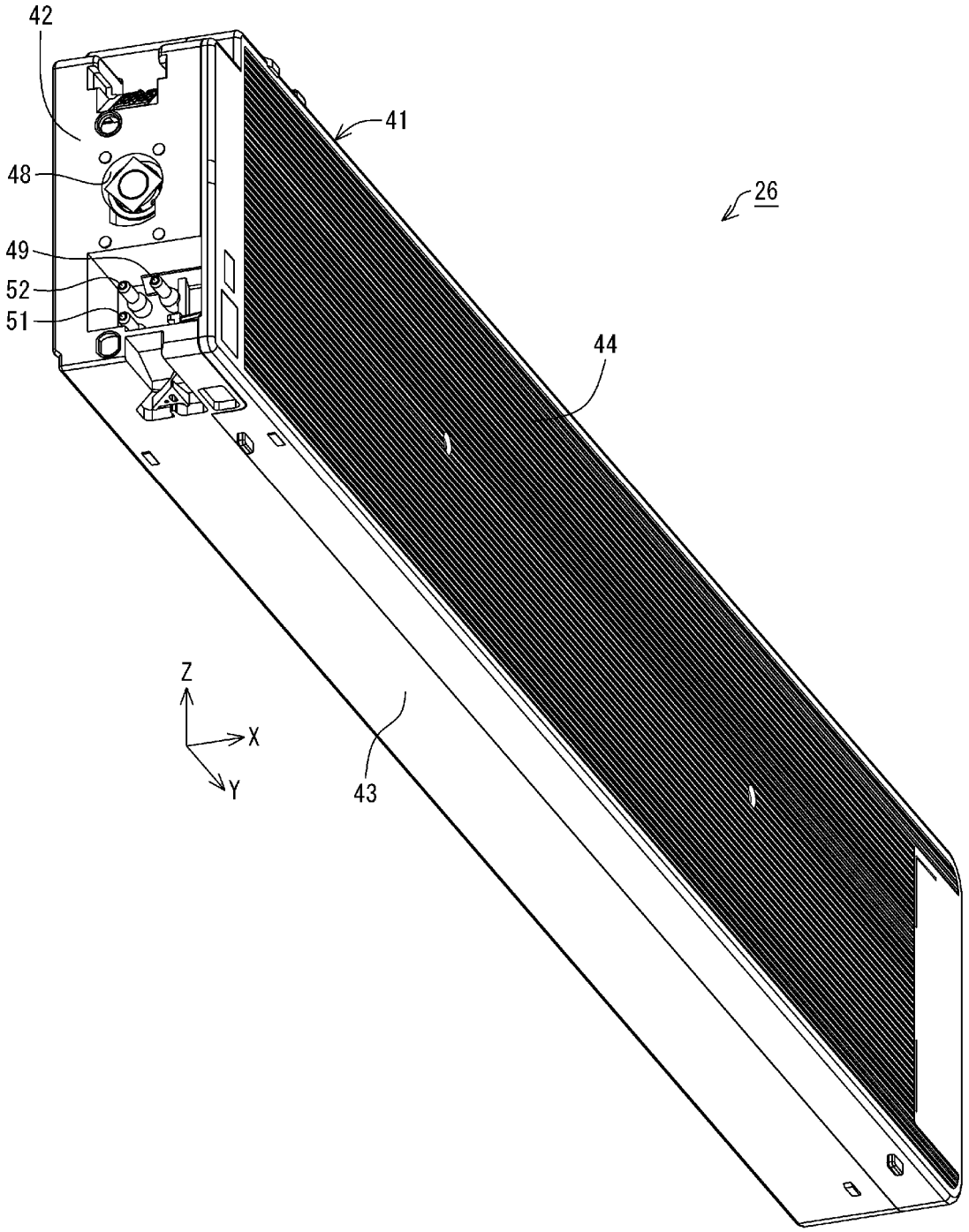
FIG. 2 is a perspective view showing a cartridge in the embodiment.

Each cartridge 26 has a case 41 as shown in FIG. 2. Each cartridge 26 has a long shape with a longitudinal dimension of approximately 550 mm along the Y axis and a height dimension of approximately 100 mm along the Z axis, for example.

Figure 3:
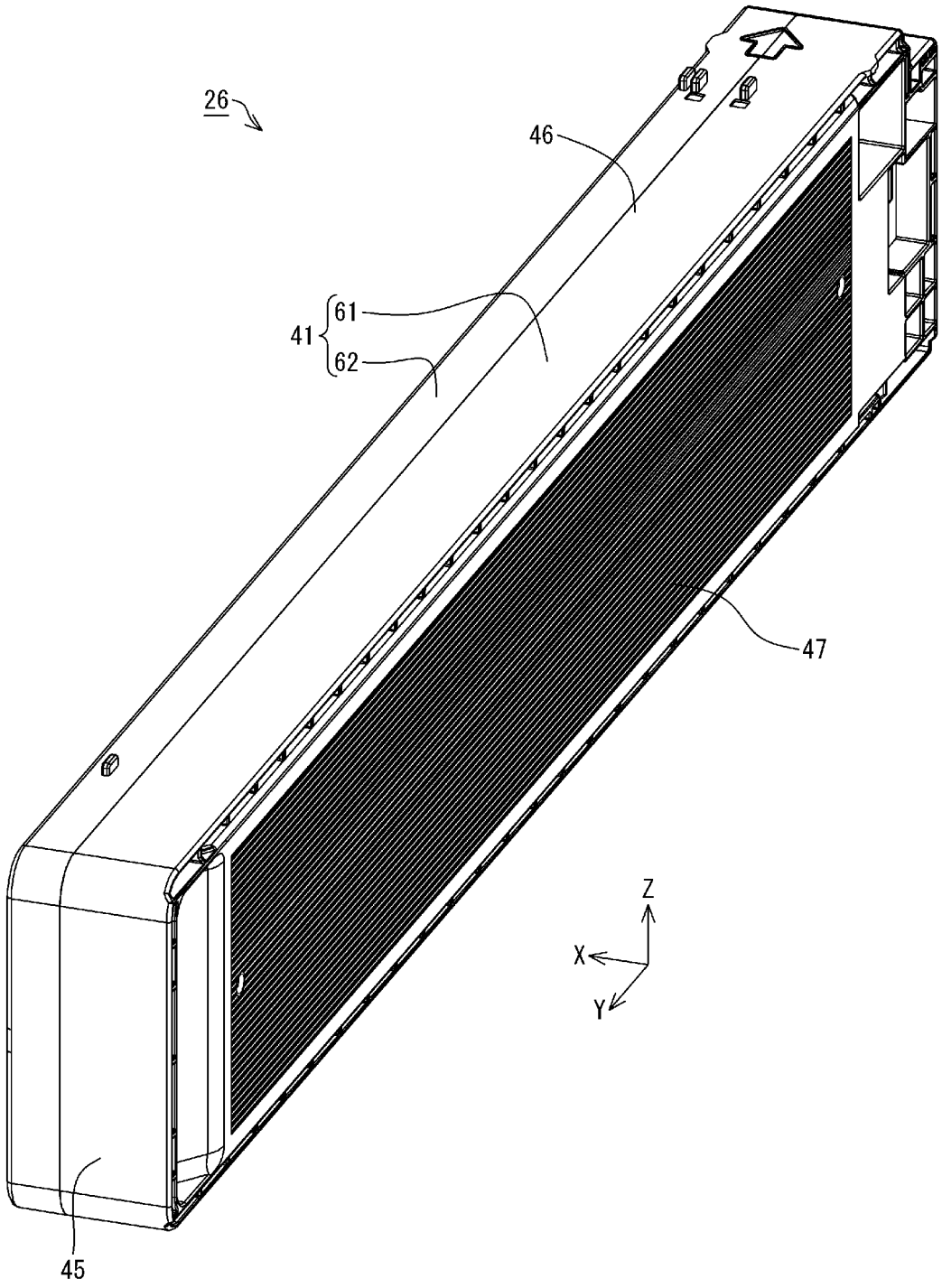
FIG. 3 is a perspective view showing the cartridge in the embodiment.

The case 41 constitutes the outer shell of the cartridge 26. The case 41 has a front face 42, a lower face 43, and a side face 44. The front face 42, the lower face 43, and the side face 44 intersect each other. As shown in FIG. 3, the case 41 also has a rear face 45, an upper face 46, and a side face 47. The rear face 45, the upper face 46, and the side face 47 intersect each other. The front face 42 also intersects the upper face 46 and the side face 47. The rear face 45 also intersects the lower face 43 and the side face 44. In addition, the front face 42 and the rear face 45 oppose each other. The lower face 43 and the upper face 46 oppose each other. The side face 44 and the side face 47 oppose each other. Note that the front face 42 is positioned at the end portion in a −Y axis direction of the cartridge 26. The rear face 45 is positioned at the end portion in a +Y axis direction of the cartridge 26. In other words, in the cartridge 26, the front face 42 is positioned at one end, and the rear face 45 is positioned at the other end. Note that the front face 42 corresponds to a first face, the rear face 45 corresponds to a second face, the lower face 43 corresponds to a third face, and the upper face 46 corresponds to a fourth face.

The front face 42, the lower face 43, the side face 44, the rear face 45, the upper face 46, and the side face 47 are not limited to flat faces, and may include uneven or curved surfaces. In addition, two faces intersecting each other do not need to be orthogonal to each other, and it suffices for the two faces intersecting each other to have a positional relationship of intersecting each other. Two faces intersecting each other means that the two faces have a positional relationship of not being parallel to each other. Thus, the invention is not limited to a configuration in which two faces intersecting each other come into direct contact, and a configuration can also be adopted in which two faces intersecting each other intersect via another flat face or a curved face. Specifically, in addition to a case where two faces are in direct contact with each other, a case where two faces have a relationship in which the extension of one of the two faces intersects the extension of the other is also expressed as "intersecting", even if the two faces have a positional relationship of not being in direct contact with each other and being apart from each other. In addition, an angle formed by two intersecting faces may be any one of a right angle, an obtuse angle, and an acute angle.

Figure 4:
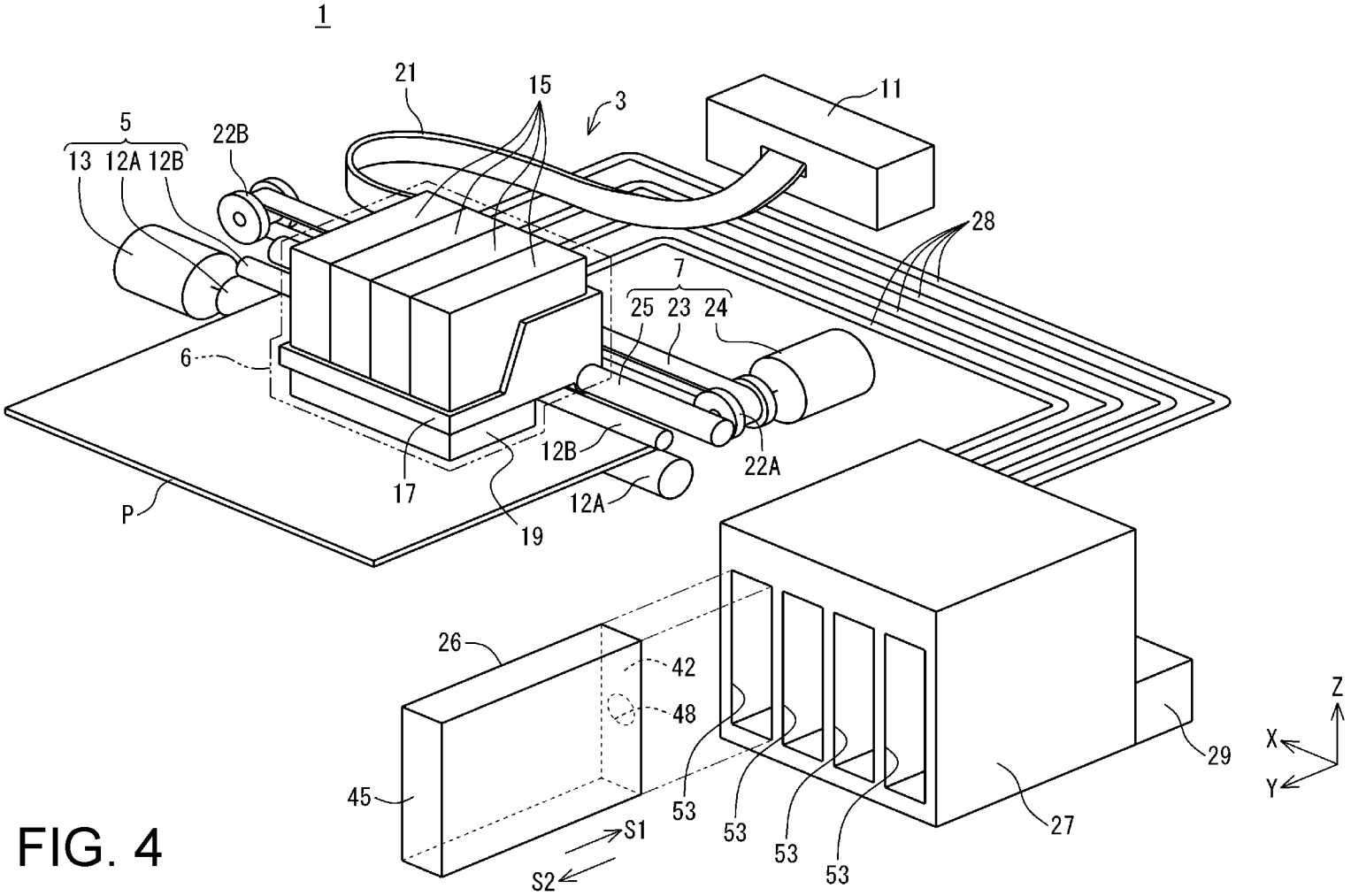
FIG. 4 is a perspective view schematically showing a main configuration of the liquid jetting system in the embodiment.

As shown in FIG. 2, a supply port 48, a pressurization port 49, a first air inlet port 51, and a second air inlet port 52 are provided in the front face 42 of the case 41. The supply port 48 is provided as an opening formed in the case 41. As shown in FIG. 4, when a cartridge 26 is mounted to the holder 27, the cartridge 26 is inserted from the supply port 48 side, in other words, from the front face 42 side into the holder 27. At this time, the front face 42 of the cartridge 26 is inserted from an opening 53 of the holder 27 into the holder 27.

Here, the direction in which the cartridge 26 is inserted into the opening 53 of the holder 27 is expressed as an insertion direction S1. Also, the direction in which the cartridge 26 is pulled out from the holder 27 is expressed as a pull-out direction S2. When the cartridge 26 is inserted into the opening 53 of the holder 27, the front face 42 faces in the insertion direction S1. In addition, the opening 53 of the holder 27 is open in the pull-out direction S2, which is the opposite direction to the insertion direction S1.

Here, the front face 42 facing in the insertion direction S1 refers to a state where the front face 42 and the insertion direction S1 are not parallel. The state where the front face 42 faces in the insertion direction S1 is not limited to a state where an angle formed by the front face 42 and the insertion direction S1 is exactly perpendicular, and includes a state where the angle formed by the front face 42 and the insertion direction S1 is an acute angle or an obtuse angle. Similarly, the opening 53 of the holder 27 being open in the pull-out direction S2 refers to a state where a face defined by the outline of the opening 53 and the pull-out direction S2 are not parallel. The state where the opening 53 is open in the pull-out direction S2 is not limited to a state where an angle formed by the face defined by the outline of the opening 53 and the pull-out direction S2 is exactly perpendicular, and includes a state where the angle is an acute angle or an obtuse angle. In this specification, the expression that a face faces a predetermined direction is not limited to a state where an angle formed by the face and the predetermined direction is exactly perpendicular, and includes a state where the angle is an acute angle and an obtuse angle.

Note that in this embodiment, the insertion direction S1 is the −Y axis direction, and the pull-out direction S2 is the +Y axis direction. Accordingly, in this embodiment, the insertion direction S1 and the pull-out direction S2 are along the Y axis. However, the insertion direction S1 and the pull-out direction S2 are not limited thereto, and a mode can also be adopted in which the insertion direction S1 is the +Y axis direction, and the pull-out direction S2 is the −Y axis direction. In addition, as the insertion direction S1 and the pull-out direction S2, various directions can be adopted such as a direction along the X axis, a direction along the Z axis, and directions respectively intersecting the X axis, the Y axis, and the Z axis.

In the ink supply apparatus 4, the supply port 48 of the cartridge 26 and the ink supply tube 28 are connected in the holder 27 when the cartridge 26 is mounted to the holder 27. The pump unit 29 is also connected to the pressurization port 49 (FIG. 2), the first air inlet port 51, and the second air inlet port 52. The pressurization port 49, the first air inlet port 51, and the second air inlet port 52 are introduction ports that introduce, into the case 41, atmospheric air that is sent in from the pump unit 29, and are connection ports to the pump unit 29. The pump unit 29 is an example of an air supply apparatus that can supply atmospheric air that is an example of air to the cartridge 26.

Figure 5:
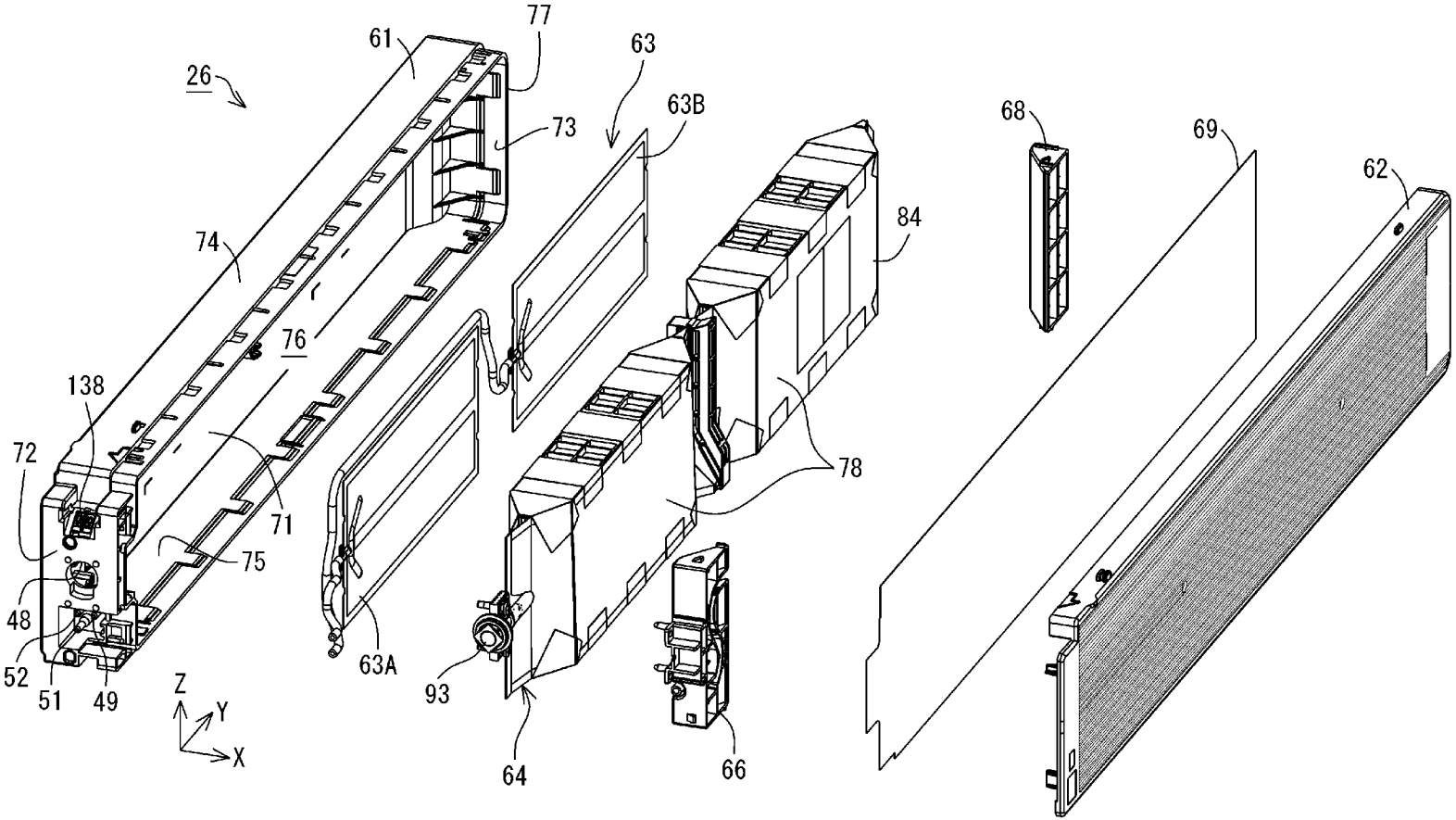
FIG. 5 is an exploded perspective view showing the cartridge in the embodiment.

The case 41 includes a first case 61 and a second case 62 as shown in FIG. 3. Also, the cartridge 26 has an air bag set 63, a pack assembly 64, a first spacer 66, a second spacer 68, and a sheet member 69 as shown in FIG. 5. The first case 61 and the second case 62 are adjacent to each other in the X axis direction. The pack assembly 64 is arranged between the first case 61 and the second case 62. The air bag set 63 is arranged between the first case 61 and the pack assembly 64. The sheet member 69 is arranged between the pack assembly 64 and the second case 62.

The first case 61 has a first wall 71, a second wall 72, a third wall 73, a fourth wall 74, and a fifth wall 75 as shown in FIG. 5. The first wall 71 intersects the X axis direction, and faces toward the second case 62. The second wall 72, the third wall 73, the fourth wall 74, and the fifth wall 75 each intersect the first wall 71. When the first wall 71 is seen in planar view from the sheet member 69 side, the first wall 71 is surrounded by the second wall 72, the third wall 73, the fourth wall 74, and the fifth wall 75.

The second wall 72 and the third wall 73 are provided at positions opposing each other so as to sandwich the first wall 71 in the Y axis direction. The fourth wall 74 and the fifth wall 75 are provided at positions opposing each other so as to sandwich the first wall 71 in the Z axis direction. The second wall 72 intersects the fourth wall 74 and the fifth wall 75. The third wall 73 also intersects the fourth wall 74, and the fifth wall 75. The second wall 72, the third wall 73, the fourth wall 74 and the fifth wall 75 protrude from the first wall 71 in a +X axis direction. Accordingly, with the first wall 71 serving as a main wall, a housing recess 76 is constituted by the second wall 72, the third wall 73, the fourth wall 74, and the fifth wall 75 that extend from the main wall in the +X axis direction.

The housing recess 76 is configured in a direction to be recessed in a −X axis direction. The housing recess 76 is open in the +X axis direction, namely, on the sheet member 69 side. In other words, the housing recess 76 is provided in a direction so as to be recessed on the side opposite to the sheet member 69 side. A joint portion 77 is provided in the edge portion in the X axis direction of the first case 61. The joint portion 77 is provided in the end portions in the X axis direction of the second wall 72 to the fifth wall 75. The joint portion 77 is continuous along the second wall 72 to the fifth wall 75 of the first case 61. The sheet member 69 has a size and shape so as to cover the housing recess 76 of the first case 61 when seen in planar view from the second case 62 side.

In planar view of the first case 61 from the second case 62 side, the joint portion 77 surrounds the housing recess 76. The sheet member 69 is joined to the joint portion 77. The air bag set 63, the pack assembly 64, the first spacer 66, and the second spacer 68 are housed in a space surrounded by the sheet member 69 and the housing recess 76. In this embodiment, the sheet member 69 is joined to the joint portion 77 through welding. The airtightness in the housing recess 76 is improved by the sheet member 69. Accordingly, the housing recess 76 is sealed by the sheet member 69.

The second case 62 is provided on the opposite side to the first case 61 side of the sheet member 69 as shown in FIG. 5. The second case 62 has a size and shape so as to cover the housing recess 76 of the first case 61 when the first case 61 is seen in planar view from the second case 62 side. The second case 62 covers the entirety of the sheet member 69, including the housing recess 76 of the first case 61. Accordingly, the air bag set 63, the pack assembly 64, the first spacer 66, the second spacer 68, and the sheet member 69 are housed between the first case 61 and the second case 62.

The aforementioned supply port 48, pressurization port 49, first air inlet port 51, and second air inlet port 52 are provided in the second wall 72 of the first case 61. The supply port 48 penetrates the second wall 72. Therefore, the supply port 48 reaches the inside of the housing recess 76. The pressurization port 49, the first air inlet port 51, and the second air inlet port 52 are provided in the second wall 72 on the fifth wall 75 side relative to the supply port 48. A channel that brings the pressurization port 49, the first air inlet port 51, and the second air inlet port 52 into communication with each other is provided piercing the second wall 72, in the housing recess 76. Atmospheric air that is sent in from the pump unit 29 (FIG. 1) passes through the channel of the pressurization port 49, the first air inlet port 51, and the second air inlet port 52, and is introduced into the housing recess 76. Note that the first wall 71 to the fifth wall 75 are not limited to a flat wall, and may be walls that include unevenness.

The housing recess 76 of the first case 61 houses the air bag set 63, the pack assembly 64, the first spacer 66, and the second spacer 68. The air bag set 63 is arranged between the pack assembly 64 and the first wall 71 that is an example of an internal wall of the case 41 (FIG. 3). Here, the pack assembly 64 has an ink container 78. Ink is contained in the ink container 78. The air bag set 63 is arranged between the first wall 71 of the first case 61 and the ink container 78.

Figure 6:
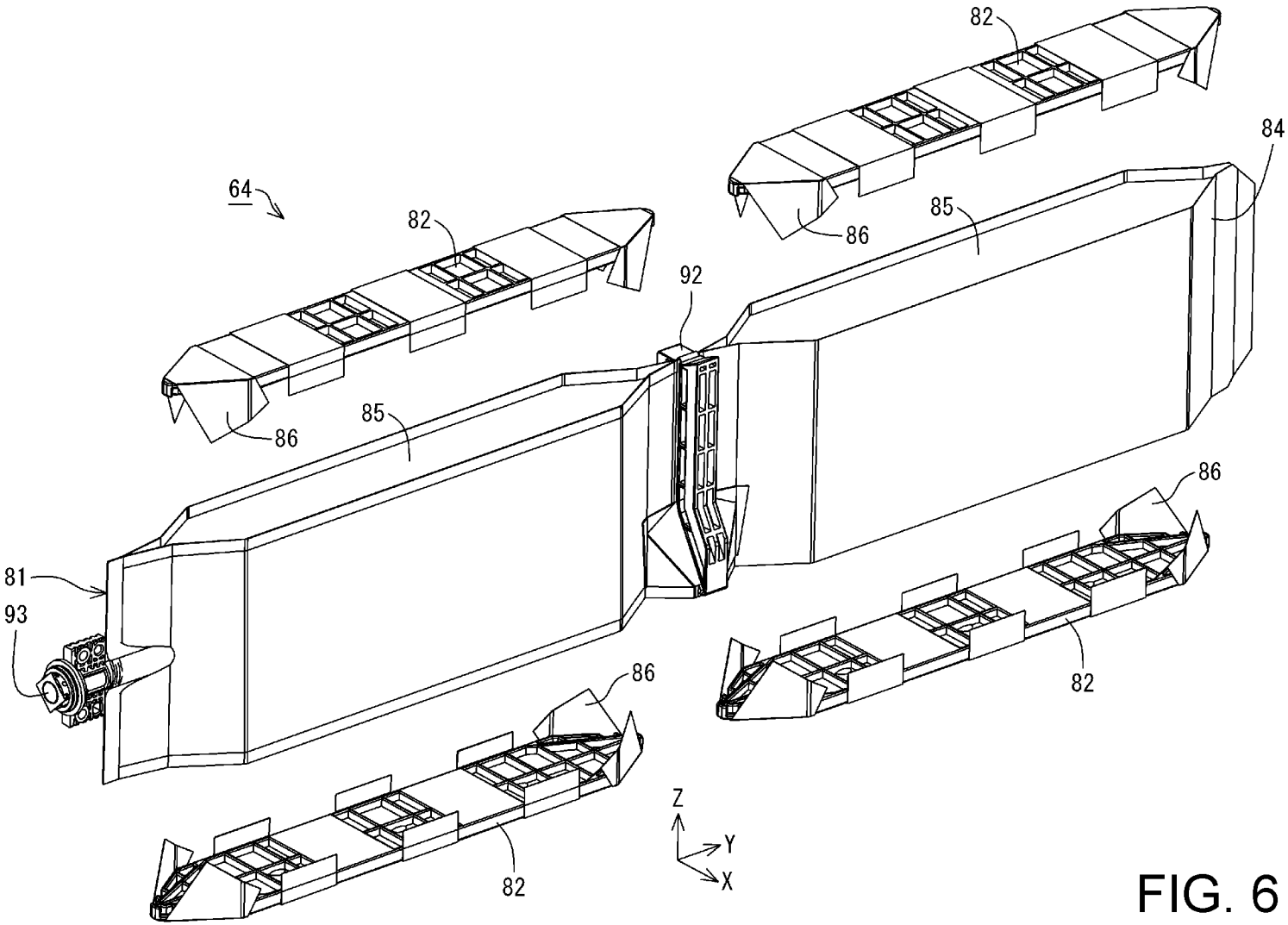
FIG. 6 is an exploded perspective view showing a pack assembly in the embodiment.

As shown in FIG. 6, the pack assembly 64 has a pack unit 81 and four spacers 82. The pack unit 81 has a bag 84. Gusset portions 85 are formed in the bag 84. The four spacers 82 each have a shape corresponding to the shape of the corresponding gusset portion 85 of the bag 84, and are fixed to the bag 84 using tape 86 in a state of being inserted into the gusset portions 85. A configuration in which the spacers 82 are incorporated in the pack unit 81 is equivalent to the pack assembly 64.

Figure 7:
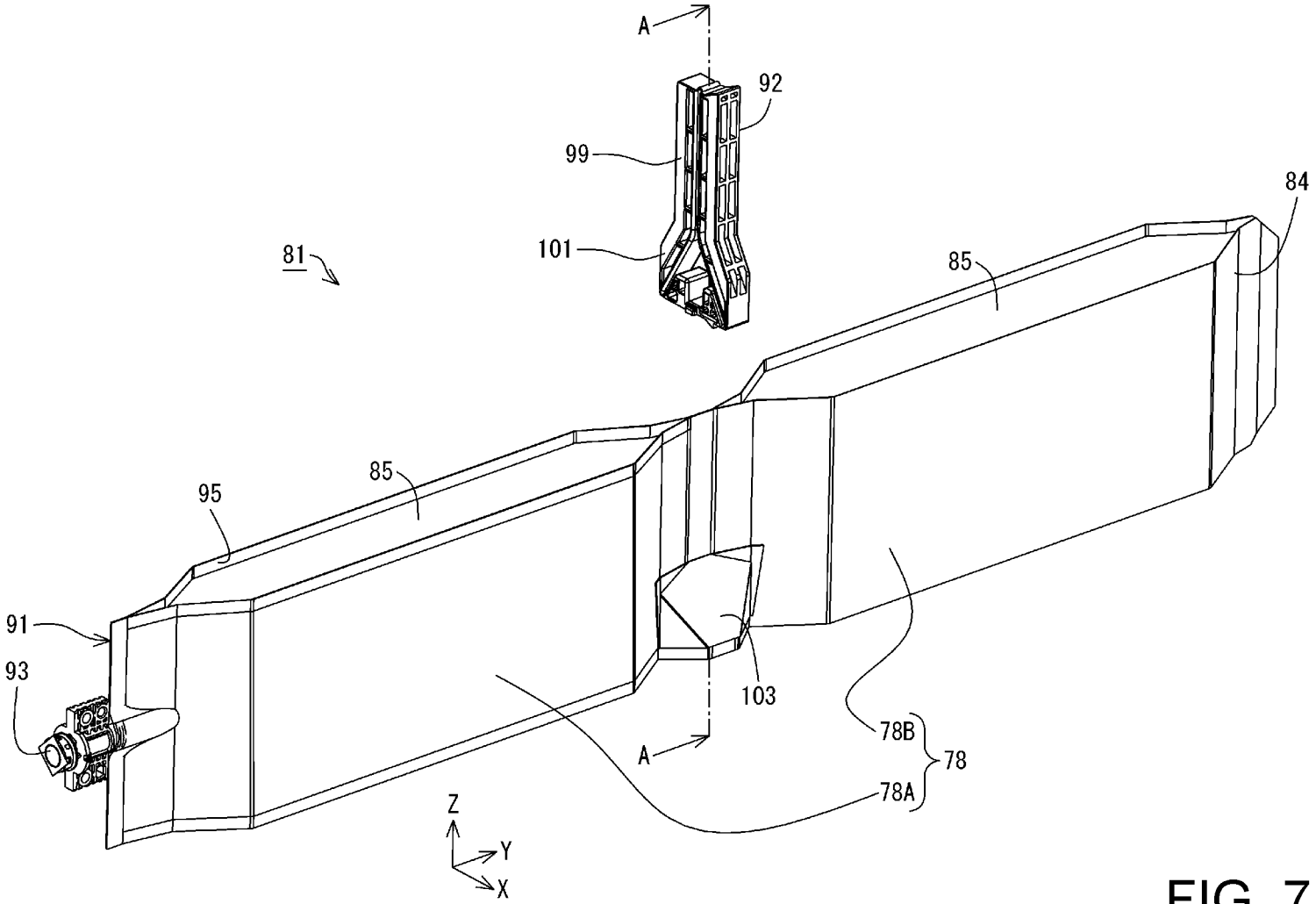
FIG. 7 is an exploded perspective view showing a pack unit in the embodiment.

As shown in FIG. 7, the pack unit 81 includes an ink pack 91 and a clamping member 92. A configuration in which the clamping member 92 is mounted on the ink pack 91 is equivalent to the pack unit 81. The ink pack 91 has a connection unit 93 and the bag 84. The bag 84 is made of a flexible film member, and the film member is joined in a bag-like shape. Ink is contained in the bag 84. In this embodiment, the bag 84 is formed by joining the film member through welding. The connection unit 93 is joined to the bag 84 at a joint portion 95 of the bag 84. Note that the bag 84 that is formed in a bag-like shape forms the ink container 78. A configuration in which the bag 84 and the connection unit 93 are joined is equivalent to the ink pack 91.

Figure 8:
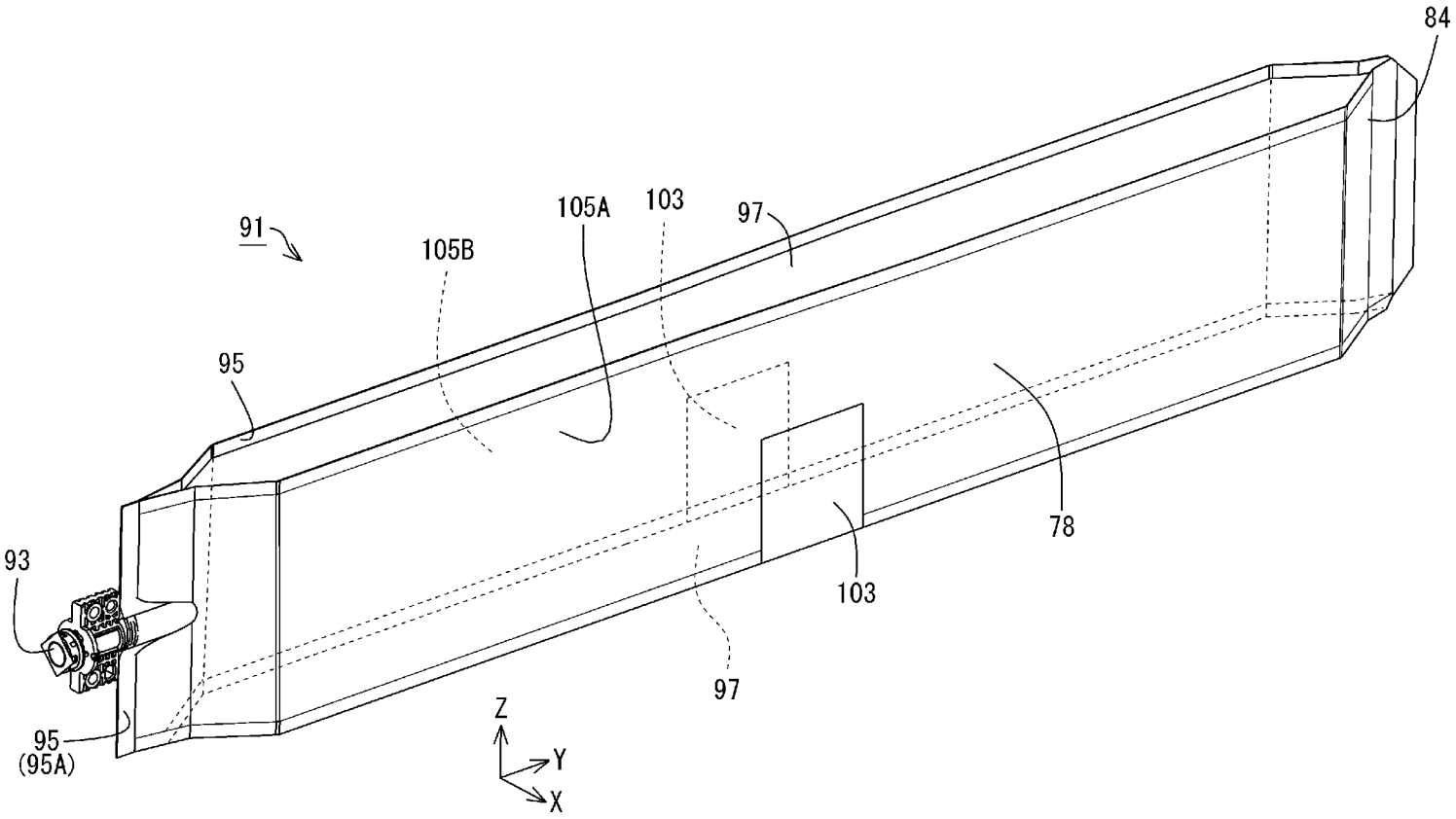
FIG. 8 is a perspective view showing the ink pack in the embodiment.

As modes of the bag 84, various modes such as a pillow-type bag, a standing pouch-type bag, and a gusset-type bag can be adopted. In this embodiment, a gusset-type bag is adopted as the bag 84 as shown in FIG. 8. The bag 84 has a joint portion 95, and is formed by joining one film member at the joint portion 95 into a bag-like shape. In the gusset-type bag 84, the joint portion 95 is provided at peripheral edges. Two gusset portions 97 are formed in the gusset-type bag 84. The two gusset portions 97 oppose each other along the Z axis.

The connection unit 93 has a function as a connection portion that enables connection between the ink container 78 and the ink supply tube 28 in the holder 27 when the cartridge 26 is mounted to the holder 27 (FIG. 4). The connection unit 93 penetrates the joint portion 95, and is inserted from outside of the bag 84 into the bag 84. The connection unit 93 and the bag 84 are joined to each other at the joint portion 95. The connection unit 93 protrudes from inside the bag 84 to outside the bag 84. In the following description, a section of the joint portion 95 that intersects the connection unit 93 is expressed as a joint portion 95A.

A channel that is in communication with the inside of the bag 84 and a valve for opening/closing the channel is provided within the connection unit 93. Ink in the bag 84 is lead to the outside of the bag 84 through the channel provided in the connection unit 93. In the ink pack 91 with the above-described configuration, the bag 84 is housed in the housing recess 76 in a state where the connection unit 93 is fitted in the supply port 48 from inside the housing recess 76 (FIG. 5). Note that a sealing member is provided between the connection unit 93 and the supply port 48. The airtightness between the connection unit 93 and the supply port 48 is improved by this sealing member. With the above-described configuration, the bag 84 in the housing recess 76 is easily pressurized by the pump unit 29.

A portion for connection (not illustrated) that is connected to the connection unit 93 is provided in the holder 27 shown in FIG. 4. The portion for connection is connected to the ink supply tube 28. When the cartridge 26 is mounted to the holder 27, the connection unit 93 and the portion for connection are connected to each other, in the holder 27. Accordingly, ink in the ink container 78 is supplied from the connection unit 93 to the ink supply tube 28 via the portion for connection.

The clamping member 92 clamps the bag 84 from outside as shown in FIG. 7. The clamping member 92 clamps the bag 84 from outside so as to extend around the bag 84. Therefore, in the pack unit 81, due to the bag 84 being clamped by the clamping member 92, one of the gusset portions 97 is sectioned into two gusset portions 85. The spacers 82 (FIG. 6) are respectively inserted into four gusset portions 85. The spacers 82 are inserted into the gusset portions 85, and thus it is possible to maintain a state where the gusset portions 85 are open. Accordingly, it is easy to avoid fatigue destruction of the film material due to repetitive deformation when the gusset portions 85 shrink and open. Also, it is possible to prevent ink from staying in the periphery of the gusset portions 85 when agitating ink in the bag 84 (which will be described later in detail).

In addition, as shown in FIG. 7, in the pack unit 81, due to the bag 84 being clamped by the clamping member 92, the ink container 78 is partitioned into a first container 78A and a second container 78B. Note that the first container 78A and the second container 78B are in communication with each other in a portion below the center in the height direction along the Z axis of the ink container 78. The first container 78A and the second container 78B are aligned in a direction along the Y axis. Note that the height direction along the Z axis is equivalent to the up-down direction, and a direction along the X axis is equivalent to a first direction, and a direction along the Y axis is equivalent to a second direction.

Figure 9:
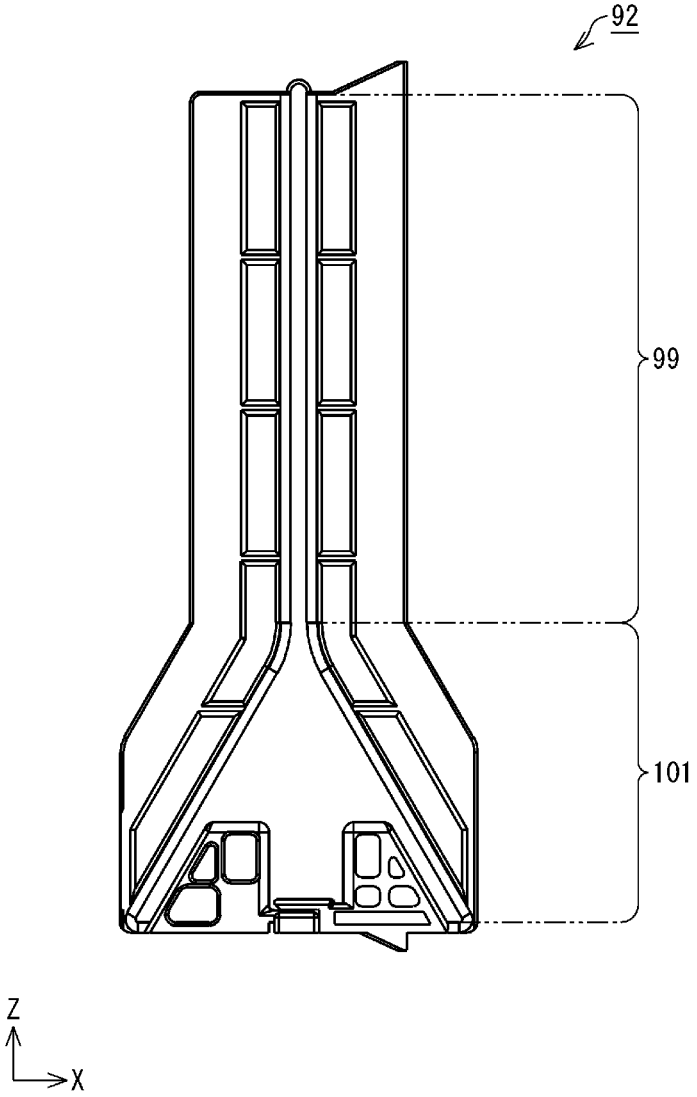
FIG. 9 is an external view showing a clamping member in the embodiment.

As shown in FIG. 9, the clamping member 92 has a clamping portion 99 that clamps the bag 84 so as to sandwich one of the gusset portions 97 of the bag 84 (FIG. 8), and an expansion holding portion 101 that holds the bag 84 in a state where a portion of the bag 84 is expanded. The one of the gusset portions 97 of the bag 84 (FIG. 8) is flattened by the clamping portion 99 of the clamping member 92, and is sectioned into the two gusset portions 85 as shown in FIG. 7. The other one of the gusset portions 97 of the bag 84 (FIG. 8) is expanded by the expansion holding portion 101.

Figure 10:
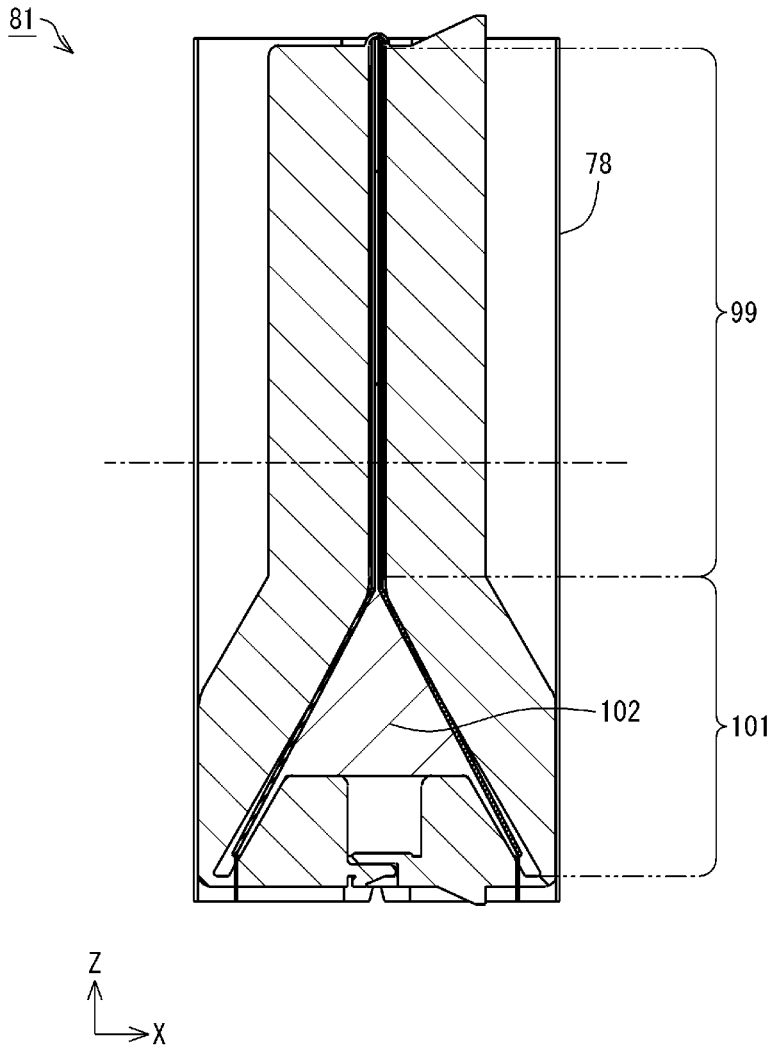
FIG. 10 is a cross-sectional view of the pack unit in the embodiment.

Accordingly, in the pack unit 81, as shown in FIG. 10 that is a cross-sectional view of the pack unit 81, a communication portion 102 is formed in a portion below the center in the height direction along the Z axis of the ink container 78. Thus, the first container 78A and the second container 78B are in communication with each other in the communication portion 102 formed in a portion below the center in the height direction along the Z axis of the ink container 78. Accordingly, at the time of agitation, ink gathered on the lower side of the second container 78B can be moved to the first container 78A side such that the concentration of ink is made uniform. Note that the cross-sectional view shown in FIG. 10 is equivalent to a cross-sectional view of the pack unit 81 when cut along the line A-A in FIG. 7.

With the above-described configuration, the first container 78A and the second container 78B are partitioned from each other at a portion clamped by the clamping portion 99 of the clamping member 92 as shown in FIG. 7, and are in communication with each other at a portion expanded by the expansion holding portion 101. In other words, the ink container 78 is partitioned into the first container 78A and the second container 78B that are in communication with each other.

Note that, in place of the expansion holding portion 101, a tubular member may be provided in the bag 84 so as to form a channel, an elastic member may be arranged in the bag 84 so as to expand the bag 84, or the bag 84 may be molded through surface pressing (which will be described later in detail) so as to form a channel in the bag 84, such that the first container 78A and the second container 78B of the bag 84 are in communication with each other.

In addition, as shown in FIG. 7, a rigidity member 103 is joined to a portion of the bag 84 overlapping the expansion holding portion 101 of the clamping member 92. The rigidity member 103 is joined to a face 105A and a face 105B of the bag 84 as shown in FIG. 8. Examples of the rigidity member 103 include a sheet material made of PET (Polyethylene terephthalate). Portions of the face 105A and the face 105B of the bag 84 to which the rigidity member 103 is joined is unlikely to deform due to the rigidity of the rigidity member 103. Therefore, as shown in FIG. 7, it is easy to maintain a state of expansion with the expansion holding portion 101. In other words, it is easy to maintain communication between the first container 78A and the second container 78B.

As shown in FIG. 5, the air bag set 63 includes a first air bag 63A and a second air bag 63B. The first air bag 63A and the second air bag 63B have similar configurations. Therefore, the configuration of the first air bag 63A will be described below in details, and a detailed description of the configuration of the second air bag 63B will be omitted. Note that the same reference numerals as those of the first air bag 63A are given to the constituent elements of the second air bag 63B that are the same as those of the first air bag 63A. Note that the first air bag 63A corresponds to the air bag of the invention.

Figure 11:
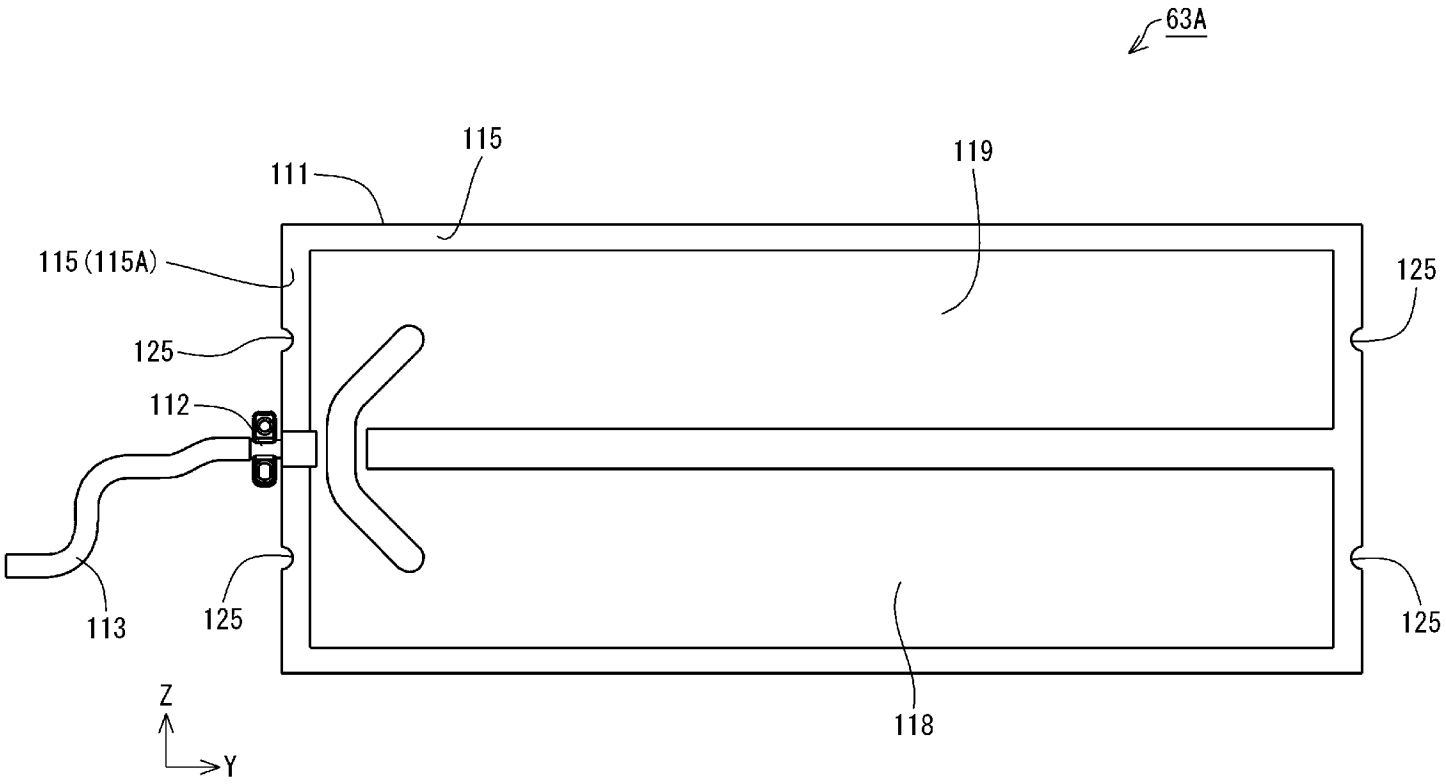
FIG. 11 is an external view showing a first air bag in the embodiment.

As shown in FIG. 11, the first air bag 63A has a bag 111, an introduction member 112, and a tube 113. The bag 111 is made of flexible film members, which are joined in a bag-like shape. In this embodiment, the bag 111 is formed by joining the film members through welding. The introduction member 112 is joined to the bag 111 at a joint portion 115 of the bag 111.

As a mode of the bag 111, various modes can be adopted such as a pillow-type bag, a standing pouch-type bag and a gusset-type bag. In this embodiment, a pillow-type bag is adopted as the bag 111. The bag 111 has a configuration in which edges of two overlapped film materials are joined through welding. The joint portion 115 is provided at the peripheral edges of the pillow-type bag 111.

The pillow-type bag 111 can be formed by joining the edges of two overlapped film materials through welding, for example. Here, the number of film materials is not limited to two. For example, the bag 111 in a bag-like shape can be formed by doubling over a single film material, and welding the overlapped end portions. In this case as well, the overlapping portion of the film material consists of two film materials. Therefore, even if the bag 111 is made of a single film material, there are two overlapping film materials. Thus, in both the case where the pillow-type bag 111 is made of a single film material, and the case where the pillow-type bag 111 is made of two or more film materials, the bag 111 has a configuration in which the edges of two overlapping film materials are joined through welding.

The introduction member 112 has a function as a connection portion that achieves connection between the bag 111 and the tube 113. The introduction member 112 penetrates the joint portion 115, and is inserted from outside the bag 111 into the bag 111. The introduction member 112 and the bag 111 are joined to each other at the joint portion 115. The introduction member 112 protrudes from inside the bag 111 to outside the bag 111. In the following description, a section of the joint portion 115 intersecting the introduction member 112 is expressed as a joint portion 115A when distinguished from the rest of the joint portion 115.

Figure 12:
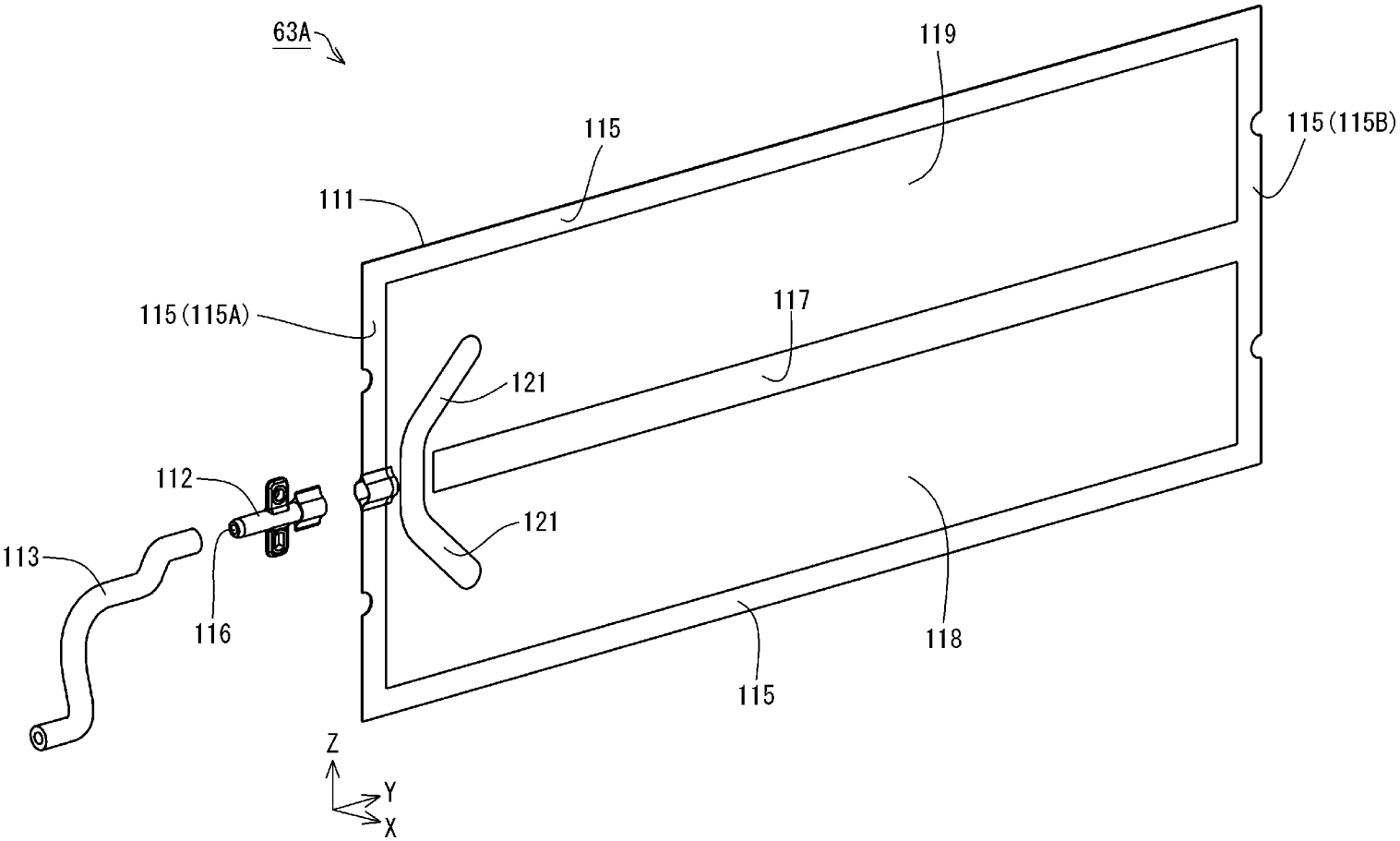
FIG. 12 is an exploded perspective view showing the first air bag in the embodiment.

As shown in FIG. 12, the introduction member 112 has an introduction port 116. The introduction port 116 is an opening formed in the introduction member 112. In a state where the introduction member 112 is joined to the bag 111, the introduction port 116 is positioned outside the bag 111. The introduction port 116 leads to the inside of the bag 111 via the introduction member 112. Thus, the first air bag 63A is configured such that the atmospheric air can be introduced from the introduction port 116 into the bag 111 via the introduction member 112. The tube 113 is connected to a portion on the introduction port 116 side of the introduction member 112. The atmospheric air can be introduced into the bag 111 via the tube 113 and the introduction member 112.

The joint portion 115 that extends around the bag 111 along the peripheral edge of the bag 111 and a joint portion 117 that partitions, into two regions, the region around which the joint portion 115 extends are formed in the bag 111. In the region around which the joint portion 115 extends, the joint portion 117 extends along the Y axis. The two regions partitioned by the joint portion 117 are called a first bag 118 and a second bag 119. The first bag 118 and the second bag 119 are aligned along the Z axis. In the usage orientation, the second bag 119 is positioned above the first bag 118.

The joint portion 117 extends in the −Y axis direction from a joint portion 1156 that is the opposite side to the joint portion 115A of the joint portion 115 that extends along the peripheral edge of the bag 111. The end portion on the +Y axis direction side of the joint portion 117 is connected to the joint portion 1156. On the other hand, the end portion on the −Y axis direction side of the joint portion 117 is spaced apart from the joint portion 115A. In other words, the joint portion 117 does not lead to the joint portion 115A. Therefore, the first bag 118 and the second bag 119 partitioned by the joint portion 117 are in communication with each other. In the first air bag 63A, the introduction port 116 is provided so as to be shared by the first bag 118 and the second bag 119. In other words, the introduction port 116 of the introduction member 112 functions in common in the first bag 118 and the second bag 119. Thus, atmospheric air that has been introduced from the introduction port 116 into the bag 111 via the introduction member 112 branches into the first bag 118 and the second bag 119, in the bag 111.

An introduction path 121 that branches into the first bag 118 and the second bag 119 from the introduction port 116 is formed in the bag 111. Due to the introduction path 121, the atmospheric air that has been introduced into the bag 111 via the introduction member 112 is likely to branch into the first bag 118 and the second bag 119. The introduction path 121 is formed by performing surface press molding on at least one film material of the two film materials that make up the bag 111.

The surface press molding is processing of partially performing stretch molding on a film material by pressing a portion of the film material using a molding mold toward the outside of the bag 111. At this time, by heating the film material and the molding mold, the processing accuracy is improved and the processing time is shortened. By performing surface press molding, the introduction path 121 is formed in a direction so as to be recessed from inside of the bag 111 toward the outside of the bag 111. By forming the introduction path 121 through surface press molding, a channel for atmospheric air can be secured as the introduction path 121 even in a state where the two film materials that make up the bag 111 adhere to each other, for example.

Note that as a method for forming the introduction path 121 other than surface press molding, a tubular member may be provided in the bag 84 so as to form a channel, an elastic member may be arranged in the bag 84 so as to expand the bag 84, or the like.

Figure 13:
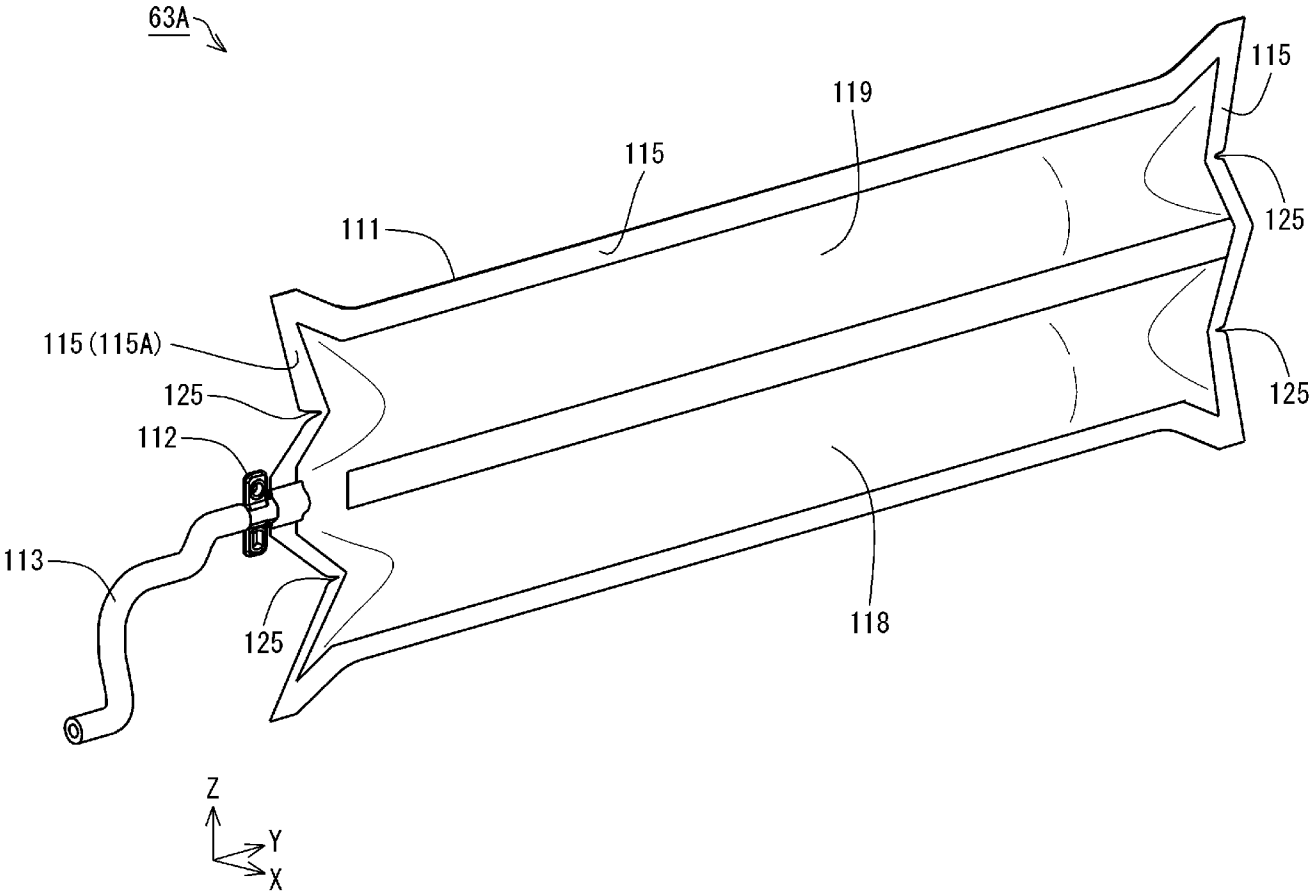
FIG. 13 is a perspective view showing the first air bag in the embodiment.

When atmospheric air is introduced into the bag 111 via the tube 113 and the introduction member 112, the first bag 118 and the second bag 119 are inflated, as shown in FIG. 13. Specifically, the first air bag 63A includes the first bag 118 that can be inflated upon being supplied with atmospheric air that is an example of air and the second bag 119 that is positioned above the first bag 118 in the usage orientation, and can be inflated upon being supplied with atmospheric air.

Here, notch portions 125 are formed in the joint portion (bonded portion) 115 as shown in FIG. 11. The notch portions 125 are formed in portions adjacent to the first bag 118 in the direction along the Y axis and portions adjacent to the second bag 119 in the direction along the Y axis, in the joint portion 115. In other words, the notch portions 125 are formed in portions adjacent to the first bag 118 and portions adjacent to the second bag 119, in the joint portion 115A and the joint portion 115B. In this embodiment, the notch portions 125 are formed at two locations adjacent to the first bag 118, respectively in the joint portion 115A and the joint portion 115B. The notch portions 125 are formed at two locations adjacent to the second bag 119, respectively in the joint portion 115A and the joint portion 115B. Therefore, four notch portions 125 are formed in the first air bag 63A.

Figure 14:
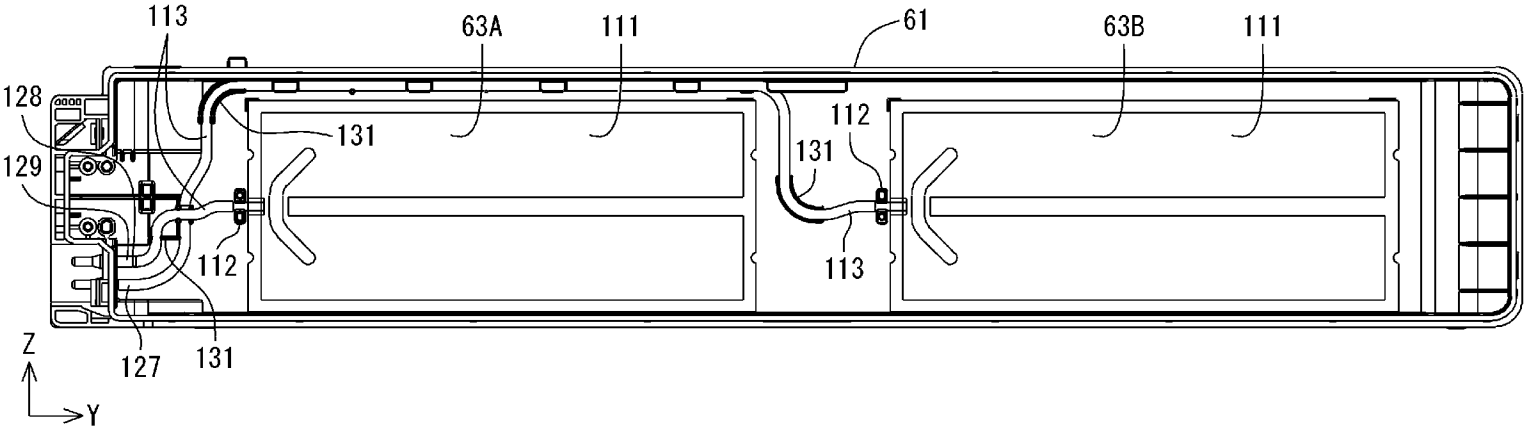
FIG. 14 is an external view showing a first case, the first air bag, and a second air bag in the embodiment.
Figure 15:
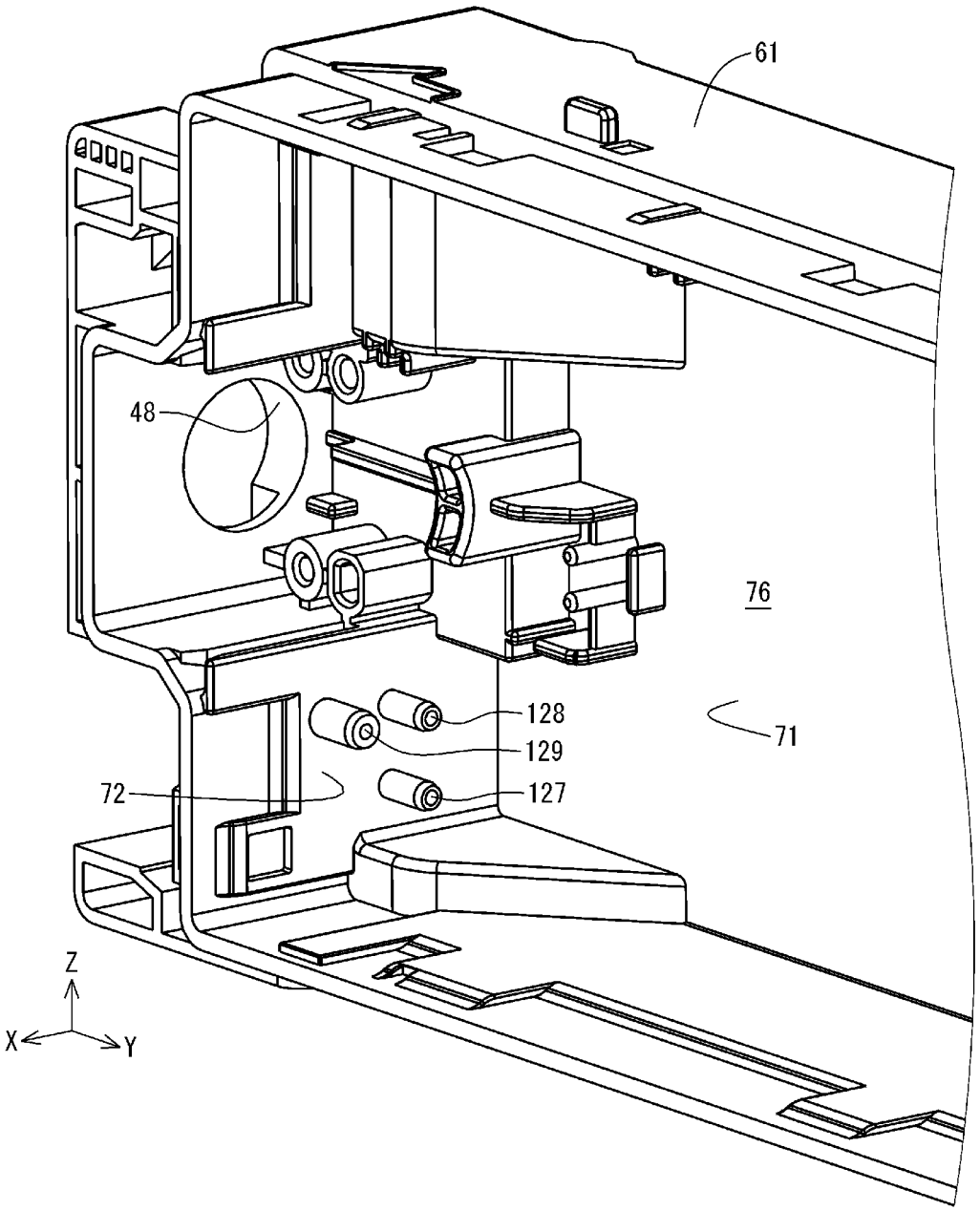
FIG. 15 is a perspective view partially showing the first case in the embodiment.

The second air bag 63B has a configuration similar to that of the first air bag 63A, except that the length of the tube 113 is different. The first air bag 63A having the above-described configuration and the second air bag 63B are housed in the first case 61, as shown in FIG. 14. Here, as shown in FIG. 15, a connection portion 127, a connection portion 128, and a connection portion 129 are provided in the first case 61. The connection portion 127, the connection portion 128, and the connection portion 129 are provided in the second wall 72 of the first case 61, and protrude from the second wall 72 in the Y axis direction. The connection portion 127 is in communication with the first air inlet port 51 (FIG. 2). The connection portion 128 is in communication with the second air inlet port 52 (FIG. 2). The connection portion 129 is in communication with the pressurization port 49 (FIG. 2).

The tube 113 of the second air bag 63B is connected to the connection portion 127. As shown in FIGS. 14 and 15, the tube 113 of the first air bag 63A is connected to the connection portion 128 positioned in the −X axis direction of the connection portion 129. As shown in FIG. 14, the second air bag 63B is housed in the first case 61 in a state where the tube 113 is connected to the connection portion 127. Similarly, the first air bag 63A is housed in the first case 61 in a state where the tube 113 is connected to the connection portion 128. Therefore, the bag 111 of the second air bag 63B is in communication with the first air inlet port 51 (FIG. 2) via the introduction member 112, the tube 113, and the connection portion 127. The bag 111 of the first air bag 63A is in communication with the second air inlet port 52 (FIG. 2) via the introduction member 112, the tube 113, and the connection portion 128.

In this embodiment, when the first air bag 63A and the second air bag 63B are housed in the first case 61, the tubes 113 of the first air bag 63A and the second air bag 63B are fixed to the first case 61. In the first case 61, claws 131 for holding the tubes 113 are provided along the arrangement path of the tubes 113. When the first case 61 is seen in planar view in the −X axis direction, the tubes 113 are arranged in a region outside of the bags 111. Therefore, when the first case 61 is seen in planar view in the −X axis direction, the tubes 113 do not overlap the bags 111. Accordingly, it is easy to avoid the prevention of inflation of the bags 111 by the tubes 113.

Figure 16:
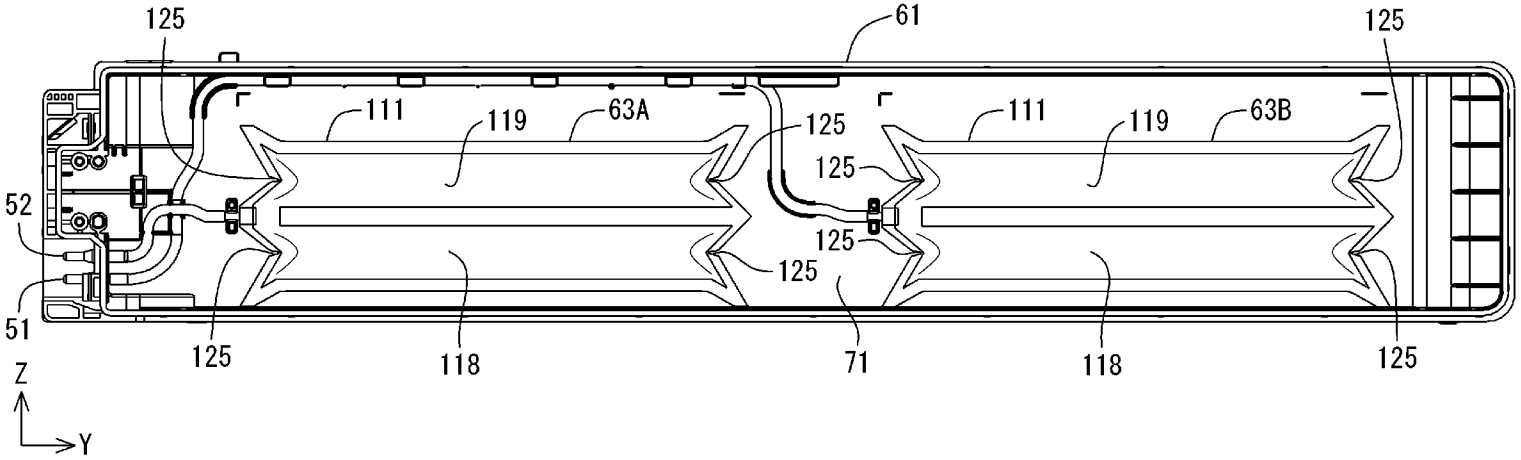
FIG. 16 is an external view showing the first case, the first air bag, and the second air bag in the embodiment.

When atmospheric air is supplied to the first air inlet port 51 and the second air inlet port 52, the first air bag 63A and the second air bag 63B are inflated as shown in FIG. 16. At this time, the dimensions along the Z axis of the bags 111 of the first air bag 63A and the second air bag 63B are reduced due to deformation caused by the inflation. In this embodiment, the first bags 118 of the first air bag 63A and the second air bag 63B are partially joined to the first wall 71 of the first case 61. Therefore, when the first air bag 63A and the second air bag 63B are inflated, the height positions along the Z axis of the bags 111 are lowered relative to the first case 61.

Note that when pillow-type bags 111 are inflated, the joint portion 115 formed through welding is likely to be resistant to inflation and deformation of the bags 111, and thus the shape of the bags 111 when inflated is unlikely to be stabilized at a fixed shape. In this regard, in this embodiment, the notch portions 125 are formed in the joint portion 115, and thus deformation of the joint portion 115 is likely to be concentrated on the notch portions 125 as shown in FIG. 13. Therefore, the shape of the pillow-type bags 111 when inflated is likely to be stabilized at a fixed shape.

Figure 17:
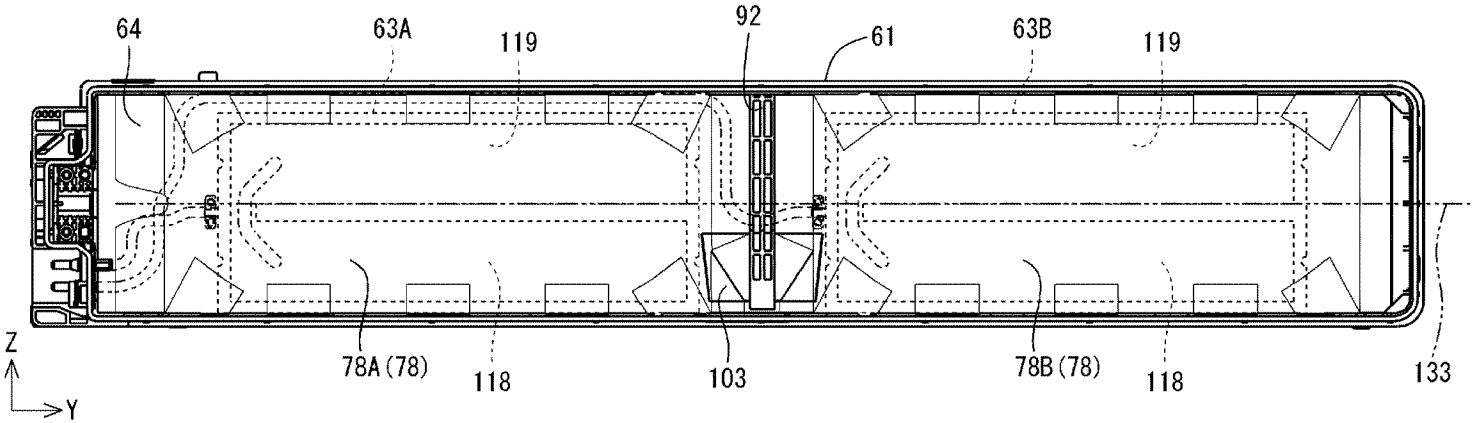
FIG. 17 is an external view showing the first case, the first air bag, the second air bag, and the pack assembly in the embodiment.

When the pack assembly 64 is housed in the first case 61 after the first air bag 63A and the second air bag 63B are housed in the first case 61, when the first case 61 is seen in planar view in the −X axis direction, the first air bag 63A is arranged at a position overlapping the first container 78A as shown in FIG. 17. Similarly, the second air bag 63B is arranged at a position overlapping the second container 78B.

In the usage orientation, when seen in planar view in the −X axis direction, the first bag 118 of the first air bag 63A is arranged at a position overlapping a portion below the center in the Z axis direction in the ink container 78. The first bag 118 of the second air bag 63B is also arranged at a position overlapping a portion below a center 133 in the Z axis direction in the ink container 78, when seen in planar view in the −X axis direction in the usage orientation.

Figure 18:
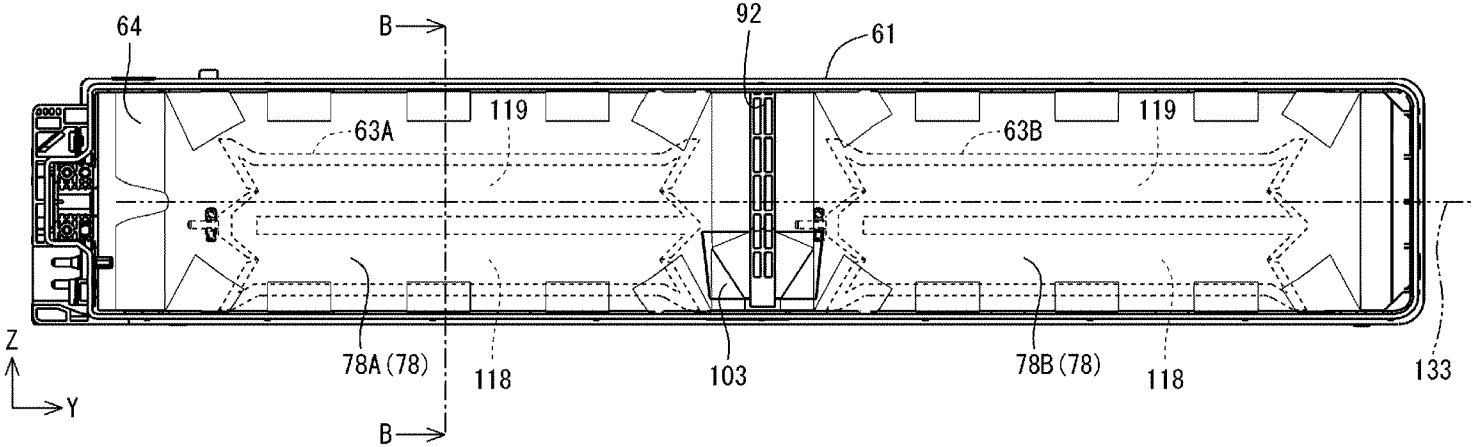
FIG. 18 is an external view showing the first case, the first air bag, the second air bag, and the pack assembly in the embodiment.
Figure 19:
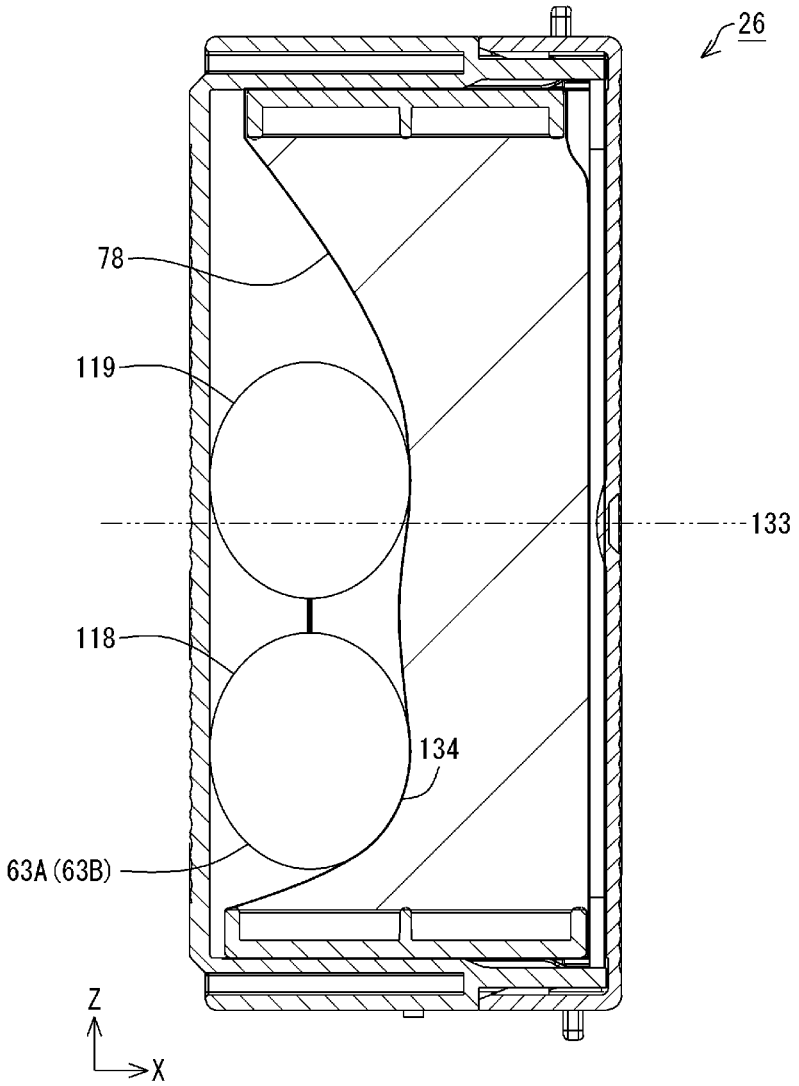
FIG. 19 is a cross-sectional view of the cartridge in the embodiment when cut along a line equivalent to a line B-B in FIG. 1.

Even when the first air bag 63A and the second air bag 63B are inflated, the first bags 118 of the first air bag 63A and the second air bag 63B are each positioned at a position overlapping a portion below the center 133 of the ink container 78 as shown in FIG. 18. At this time, as shown in FIG. 19 that is a cross-sectional view of the cartridge 26 when cut along a line equivalent to a line B-B in FIG. 18, the first bag 118 comes into contact with the ink container 78. In other words, the first air bag 63A and the second air bag 63B can come into contact with the ink container 78 in a state of being inflated upon receiving a supply of atmospheric air that is an example of air. At this time, a portion 134 at which the first bag 118 and the ink container 78 abut against each other is positioned below the center 133 of the ink container 78.

In the usage orientation, a state where the first bag 118 overlaps a portion below the center 133 in the Z axis direction in the ink container 78 when seen in planar view in the −X axis direction means that the portion 134 at which the first bag 118 and the ink container 78 abut against each other is positioned below the center 133 of the ink container 78. Therefore, as long as the abutting portion 134 is positioned below the center 133 of the ink container 78, a configuration in which the first bag 118 projects upward of the center 133 of the ink container 78 is also included in the state where the first bag 118 overlaps a portion below the center 133 of the ink container 78.

Figure 20:
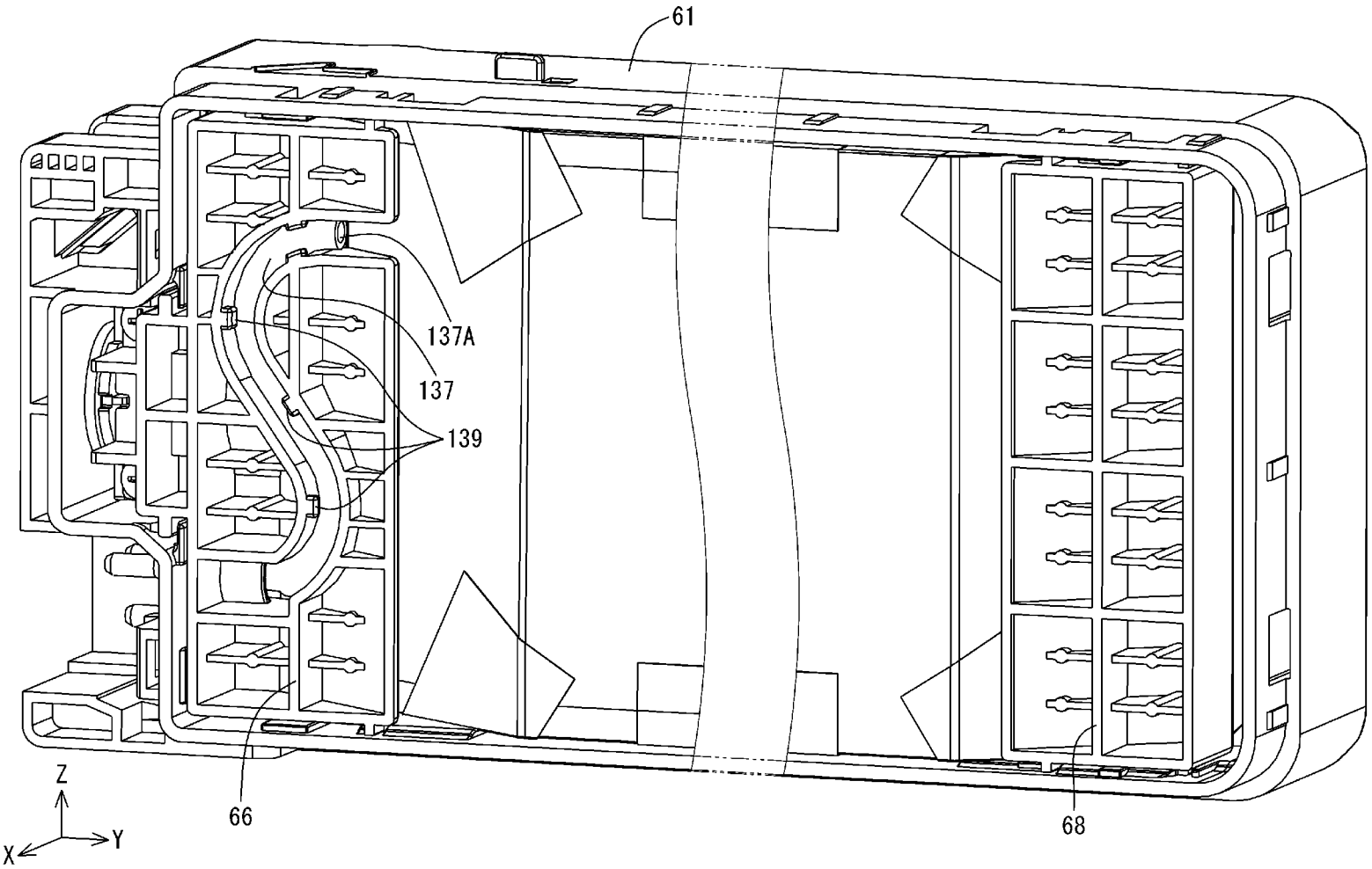
FIG. 20 is a perspective view showing the first case, the pack assembly, a first spacer, and a second spacer in the embodiment.
Figure 21:
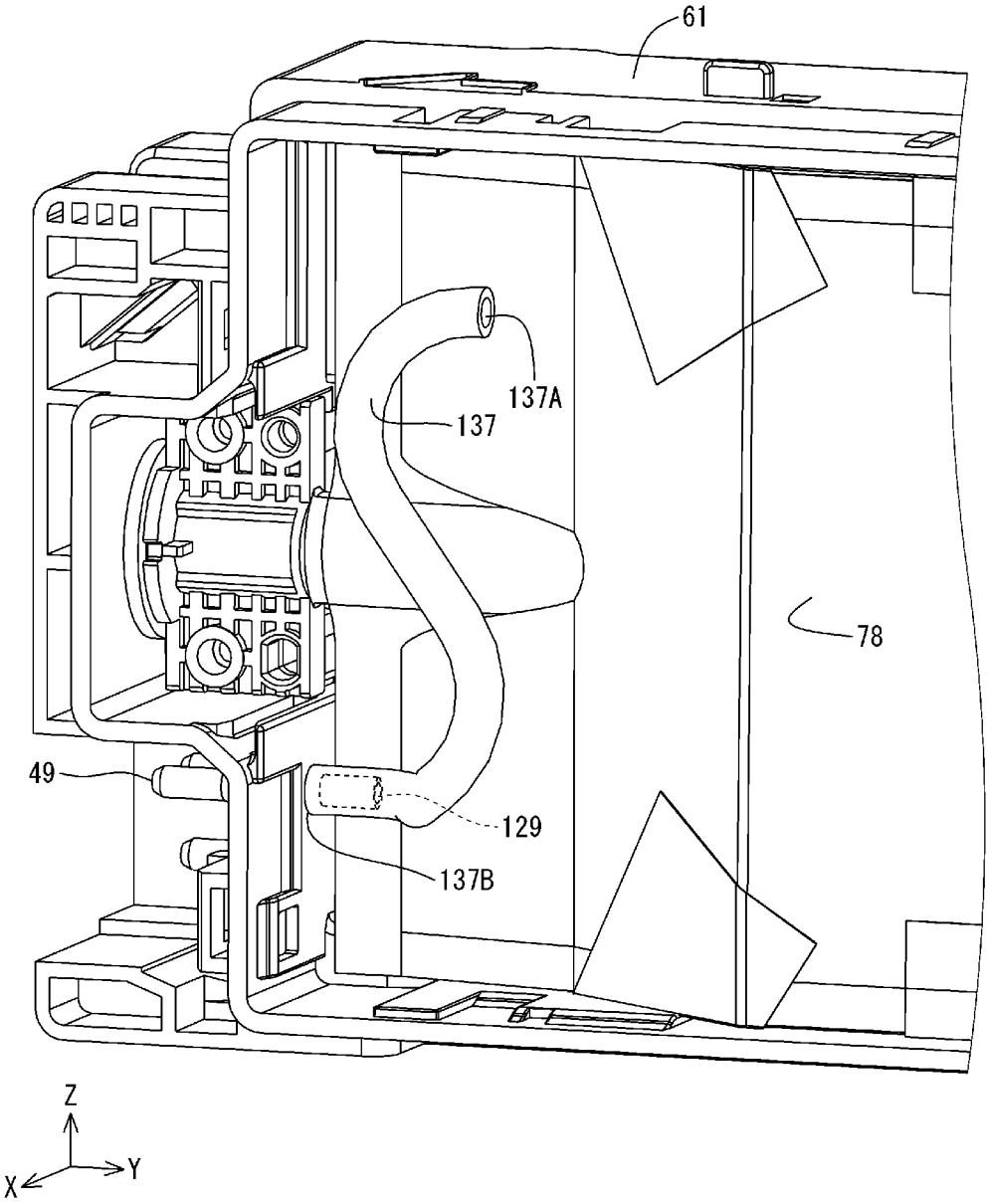
FIG. 21 is a perspective view showing the first case, the pack assembly, and a tube in the embodiment.

After the air bag set 63 and the pack assembly 64 are housed in the first case 61, the first spacer 66 and the second spacer 68 are housed in the first case 61 as shown in FIG. 20. Here, a tube 137 is arranged in the first spacer 66. One end 137A of the tube 137 is open toward the inside of the first case 61, in other words, toward an inner portion of the case 41. The other end 137B of the tube 137 is connected to the connection portion 129 as shown in FIG. 21. As described above, the connection portion 129 is in communication with the pressurization port 49.

Atmospheric air supplied to the pressurization port 49 by the pump unit 29 is introduced from the connection portion 129 into the first case 61 via the tube 137 and the one end 137A of the tube 137. Accordingly, pressure is applied to the ink container 78. The tube 137 connected to the connection portion 129 is open toward the inside of the first case 61, at the one end 137A positioned above the connection portion 129. In this embodiment, when all of the ink in the ink container 78 has leaked out of the ink container 78, the opening of the one end 137A of the tube 137 is positioned higher than the liquid surface of the ink in the initial state when the cartridge 26 is mounted to the liquid jetting system 1. Accordingly, it is possible to prevent ink that has leaked out of the ink container 78 from leaking to the outside from the case 41 via the pressurization port 49.

In addition, by arranging an IC chip 138 above the pressurization port 49 in the Z axis direction, malfunctions, contact failures, and the like of the IC chip 138 can be prevented even if ink leaks out from the pressurization port 49 (see FIG. 5). Note that information regarding ink and the like are recorded in the IC chip 138. With the liquid jetting system 1, when the cartridge 26 is mounted, or the like, it is possible to read information from the IC chip 138, record new information or the like in the IC chip 138, and the like. In other words, it is possible to exchange information between the liquid jetting system 1 and the IC chip 138.

In this embodiment, as shown in FIG. 20, the tube 137 is buried in the first spacer 66. Therefore, the tube 137 can be effectively arranged in the first case 61, and thus the size of the cartridge 26 can be easily reduced. Note that a claw 139 that fixes the tube 137 is provided in the first spacer 66. The tube 137 can be fixed using the claw 139, and thus coming off of the tube 137 can be suppressed.

Figure 22:
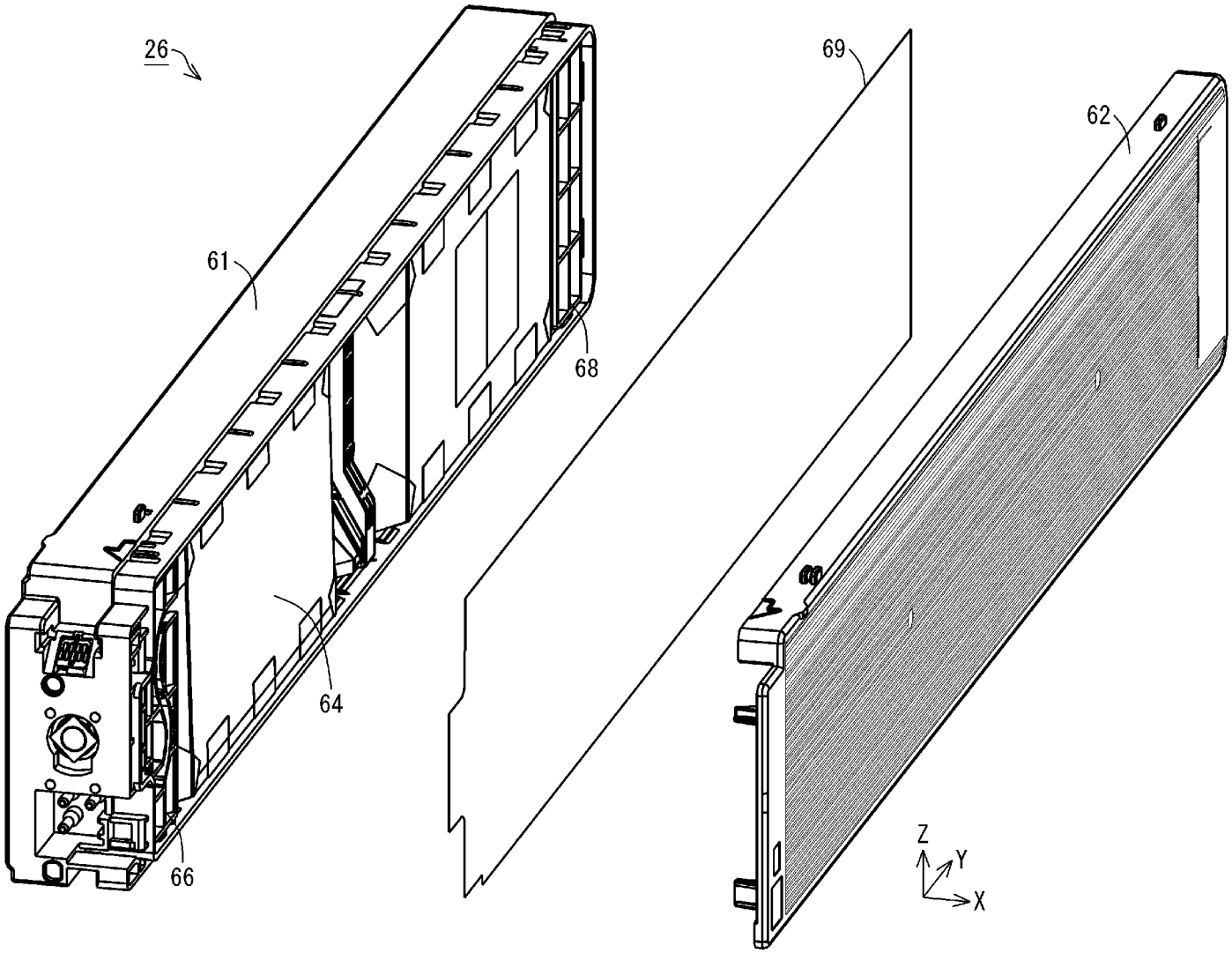
FIG. 22 is an exploded perspective view showing the cartridge in the embodiment.

After the air bag set 63, the pack assembly 64, the first spacer 66, and the second spacer 68 are housed in the first case 61, the sheet member 69 is joined to the first case 61 as shown in FIG. 22. The sheet member 69 is provided in the X axis direction of the first case 61. Accordingly, the airtightness of a region surrounded by the first case 61 and the sheet member 69 is improved.

When the cartridge 26 having the above-described configuration is mounted to the holder 27 (FIG. 4), a hollow supply needle (not illustrated) provided in the holder 27 is fitted in the connection unit 93 of the pack assembly 64 (FIG. 6). Accordingly, the valve inside the connection unit 93 is opened, and ink in the cartridge 26 is led out from the channel in the connection unit 93 to the ink supply tube 28 (FIG. 4) via the supply needle.

In addition, when the cartridge 26 is mounted to the holder 27, the pump unit 29 (FIG. 4) is connected to the pressurization port 49. The atmospheric air is then sent from the pump unit 29 into a space surrounded by the first case 61 and the sheet member 69, in other words, the housing recess 76 (FIG. 5). Accordingly, the bag 84 of the pack assembly 64 is pressurized in the cartridge 26. As a result, ink in the bag 84 is sent into the printing head 19 via the ink supply tube 28 (FIG. 4).

Incidentally, there are cases where a difference in the concentration of ink in the cartridge 26 occurs in the up-down direction due to gravity. For example, regarding pigment ink, there are cases where the pigment precipitates on the lower side of the bag 84 due to gravity. In such a case, there are cases where a difference in concentration occurs in the up-down direction. In this embodiment, ink in the bag 84 can be agitated by the air bag set 63.

Note that the ink is not limited to being either pigment ink or dye ink. Also, pigment ink may have a configuration in which a dispersoid such as pigment is dispersed in a water-based dispersion medium, a configuration in which a dispersoid such as pigment is dispersed in an oil-based dispersion medium, and the like. Dye ink may have a configuration in which a solute such as dye is dissolved in a water-based solvent, a configuration in which a solute such as dye is dissolved in an oil-based solvent, and the like.

Examples of methods for agitating ink in the bag 84 using the air bag set 63 include a method of alternately inflating the first air bag 63A and the second air bag 63B. At this time, when inflating one of the first air bag 63A and the second air bag 63B, by opening the other to the atmospheric air, it is possible to avoid inflation of both the first air bag 63A and the second air bag 63B.

By alternately inflating the first air bag 63A and the second air bag 63B, it is possible to alternately press the first container 78A and the second container 78B. This makes it possible to allow ink to flow from the first container 78A to the second container 78B and ink to flow from the second container 78B to the first container 78A. Accordingly, it is possible to allow ink to flow between the first container 78A and the second container 78B. Thus, turbulence in the ink in the bag 84 occurs, and ink can be agitated effectively. As a result, the difference in concentration in the up-down direction can be effectively reduced.

As described above, in the first air bag 63A and the second air bag 63B, the first bag 118 is arranged at a position overlapping a portion below the center 133 in the Z axis direction of the ink container 78. Therefore, when the air bag set 63 is inflated upon being supplied with atmospheric air, the first bag 118 can come into contact with the portion below the center 133 of the ink container 78. Accordingly, the inflated air bag set 63 easily reaches a lower portion of the ink container 78. Thus, with this cartridge 26, the lower side of the ink container 78 is pressed efficiently, and the effect of agitating ink in the ink container 78 is easily improved.

Also, at this time, in the first air bag 63A and the second air bag 63B, the second bag 119 comes into contact with the ink container 78 above the first bag 118. Accordingly, when a lower portion of the ink container 78 is pressed by the first bag 118, it is easy to suppress movement of ink in the ink container 78 toward a position above the ink container 78. As a result, it is possible to allow ink to effectively flow between the first container 78A and the second container 78B. Thus, a difference in the concentration in the up-down direction can be reduced more effectively.

In addition, in this embodiment, in the first air bag 63A and the second air bag 63B, the notch portions 125 are provided in the bag 111 as shown in FIG. 16. Accordingly, the shape of the pillow-type bag 111 when inflated is easily stabilized at a fixed shape. As a result, a stable agitation effect is likely to be acquired, and thus it is possible to easily improve the agitation effect further.

For example, if the shape of the bag 111 when inflated is not stable at a fixed shape, a mode in which the ink container 78 is pressed by the air bag set 63 is likely to change every time the ink container 78 is pressed, and thus a stable agitation effect is unlikely to be acquired. In this regard, with the cartridge 26 of this embodiment, by deforming the joint portion 115 centered on the notch portions 125 whose rigidity is lower than that of the periphery thereof, the shape of the pillow-type bag 111 when inflated is easily stabilized at a fixed shape. Thus, in this embodiment, a stable agitation effect is easily acquired.

Note that in this embodiment, the bag 84 is made of flexible film materials, and thus the entirety of the ink container 78 is flexible. However, a configuration may also be adopted in which only a portion of the ink container 78 that is pressed by the air bag set 63 is flexible. This is because the agitation effect as per the air bag set 63 is also acquired with this configuration. Therefore, it suffices for at least a portion of the ink container 78 to be flexible. Regarding the air bag set 63 as well, it suffices for at least a portion of the bag 111 to be flexible.

In this embodiment, a plurality of types of cartridges 26 in which the volume of the ink container 78 is different are set. For example, two types of cartridges 26 having different capacities can be set as the volumes of the ink containers 78. The cartridge 26 in which the volume of the ink container 78 is larger is suitable for ink whose consumption amount is larger. On the other hand, compared to the cartridge 26 shown in FIG. 5, the cartridge 26 in which the volume of the ink container 78 is smaller is suitable for ink whose consumption amount is smaller as shown in FIG. 23.

Figure 23:
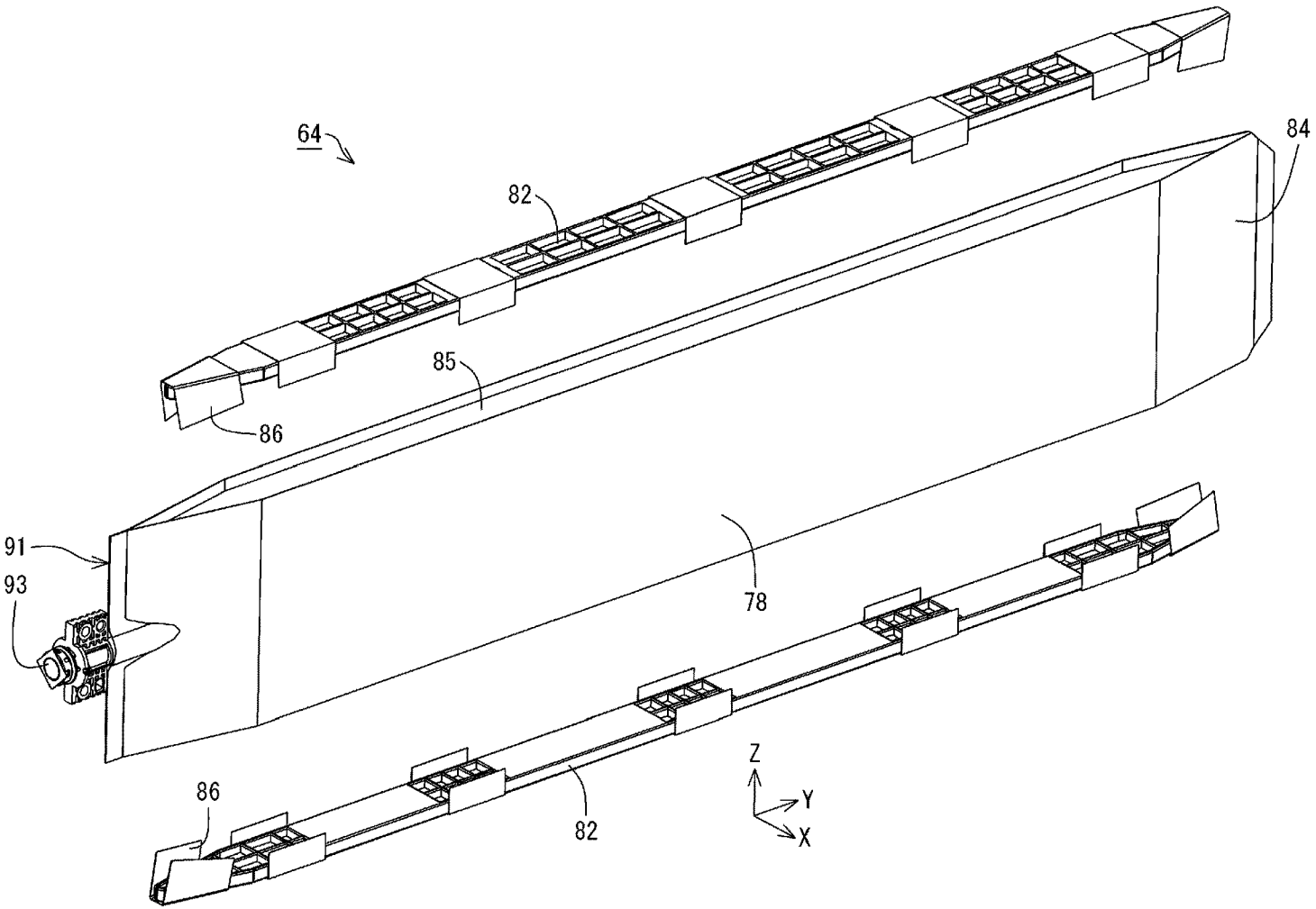
FIG. 23 is an exploded perspective view showing another example of the ink pack in the embodiment.

Note that in the example of the ink container 78 shown in FIG. 23, the volume of the bag 84 is small compared to the ink container 78 shown in FIG. 5. Accordingly, in the example of the ink container 78 shown in FIG. 23, the volume of ink that can be contained is small compared to the ink container 78 shown in FIG. 5. For example, when the rate at which a printed article including many characters such as a document is printed is high, the consumption amount of black ink is relatively large compared to that of color ink. In such a case, it is conceivable that black ink is contained in the cartridge 26 in which the volume of the bag 84 is larger, and color ink is contained in the cartridge 26 in which the volume of the bag 84 is smaller.

In the ink pack 91 that contains color ink, one ink container 78 is provided for one bag 84. Accordingly, in the ink pack 91 that contains color ink, the bag 84 is not partitioned into the first container 78A and the second container 78B. Therefore, two spacers 82 are applied to the ink pack 91 that contains color ink.

The invention is not limited to the above embodiments and working examples and can be achieved as various configurations without departing from the gist of the invention. For example, the technical features in the embodiments and the working examples that correspond to the technical features in the modes described in the summary of the invention can be replaced or combined as appropriate in order to solve a part of, or the entire foregoing problem, or to achieve some or all of the above-described effects. The technical features that are not described as essential in the specification may be deleted as appropriate.

What is claimed is:

1. A cartridge that is mountable to a liquid jetting apparatus that includes an air supply apparatus that supplies air and a liquid jetting unit that jets liquid, the cartridge comprising:

a liquid container that contains the liquid, at least a portion of the liquid container being flexible;

a case that includes the liquid container; and an air bag that is positioned between an internal wall of the case and the liquid container, at least a portion of which is flexible, and that contacts with the liquid container in a state of being expanded upon being supplied with the air, wherein the air bag includes, a first bag that is expanded upon being supplied with the air, and a second bag that is positioned above the first bag when the cartridge is in use, and is expanded upon being supplied with the air, wherein the first bag and the second bag are fluidly dependent on each other, the air bag and the liquid container are aligned in a first direction intersecting an up-down direction when the cartridge is in use, and when the cartridge is in use and the cartridge is viewed in the first direction, the first bag is arranged to overlap a lower part of the center in the up-down direction of the liquid container.

2. The cartridge according to claim 1, wherein the air bag includes a pillow-type bag, the pillow-type bag is divided into the first bag and the second bag.

3. The cartridge according to claim 2, wherein the pillow-type bag includes a configuration in which edges of two overlapped film materials are joined through welding, and in a joint portion formed through welding, notch portions are formed in a portion adjacent to the first bag in a direction intersecting the up-down direction and the first direction, and a portion adjacent to the second bag in the direction intersecting the up-down direction and the first direction.

4. The cartridge according to claim 3, wherein an introduction port for introducing the air into the air bag is included so as to be shared by the first bag and the second bag, an introduction path that branches into the first bag and the second bag from the introduction port is formed in the pillow-type bag, and the introduction path includes a configuration in which surface press molding has been performed on at least one film material out of the two film materials.

5. The cartridge according to claim 1, further comprising:

a second air bag that is expanded upon being supplied with the air, wherein the liquid container is divided into a first container and a second container, the first container and the second container are aligned in a second direction intersecting the up-down direction and the first direction, and are communicated with each other at a lower part of the center in the up-down direction of the liquid container, and the first air bag is arranged at a position opposing the first container, and the second air bag is arranged at a position opposing the second container.

6. The cartridge according to claim 5, wherein the liquid container is a flexible bag, and is divided into the first container and the second container by a clamping member that clamps a portion of the bag from outside the bag.

7. The cartridge according to claim 6, wherein the clamping member includes a clamping portion that clamps the bag and an expansion holding portion that is configured to communicate the first container and the second container with each other by holding a portion of the bag in a state of being expanded, and a rigidity member is configured to heighten rigidity of the bag, the rigidity member is joined to a portion of the bag overlapping with the expansion holding portion.

* * * * *